US011998096B2

(12) United States Patent
Marquez

(10) Patent No.: US 11,998,096 B2
(45) **Date of Patent: *Jun. 4, 2024**

(54) SYSTEMS, DEVICES AND METHODS FOR STORAGE OF, AND RAPID ACCESS TO ITEMS

(71) Applicant: IMC, LLC, Albuquerque, NM (US)

(72) Inventor: Gino Raymond Marquez, Albuquerque, NM (US)

(73) Assignee: IMC, LLC, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/133,401

(22) Filed: Apr. 11, 2023

(65) Prior Publication Data

US 2023/0248128 A1 Aug. 10, 2023

Related U.S. Application Data

(63) Continuation of application No. 16/993,768, filed on Aug. 14, 2020, now Pat. No. 11,647,818.

(60) Provisional application No. 62/889,477, filed on Aug. 20, 2019, provisional application No. 62/888,936, filed on Aug. 19, 2019, provisional application No. 62/888,293, filed on Aug. 16, 2019.

(51) Int. Cl.

| | |
|---|---|
| ***A45C 5/06*** | (2006.01) |
| ***A41D 1/04*** | (2006.01) |
| ***A45F 3/00*** | (2006.01) |
| ***A45F 3/04*** | (2006.01) |
| ***A45F 3/06*** | (2006.01) |
| ***A45F 5/02*** | (2006.01) |

(52) U.S. Cl.

CPC ..... *A45C 5/065* (2013.01); *A45F 5/022* (2013.01); *A41D 1/04* (2013.01); *A45F 2003/003* (2013.01); *A45F 3/04* (2013.01); *A45F 3/06* (2013.01)

(58) Field of Classification Search

CPC .. A45F 5/022; A45F 5/044; A45F 3/04; A45F 3/06; A45C 5/065; A41D 13/0012

USPC ..... 224/196, 645, 582, 583; 383/33

See application file for complete search history.

(56) References Cited

U.S. PATENT DOCUMENTS

| | | | |
|---|---|---|---|
| 2,840,437 | A | 6/1958 | Hyam |
| 5,251,743 | A | 10/1993 | Pulido et al. |
| D360,510 | S | 7/1995 | Slovak |
| 5,628,443 | A | 5/1997 | Deutsch |
| 5,657,917 | A | 8/1997 | Johnson et al. |
| 5,687,819 | A | 11/1997 | Lodge |
| 5,927,450 | A | 7/1999 | Sadow |

(Continued)

OTHER PUBLICATIONS

International Search Report and Written Opinion for corresponding international application No. PCT/US2020/046377, dated Nov. 24, 2020, in 12 pages.

*Primary Examiner* — Justin M Larson

(74) *Attorney, Agent, or Firm* — Procopio, Cory, Hargreaves & Savitch LLP

(57) ABSTRACT

Rapid access storage devices and systems are provided herein, which allow a user to quickly retrieve items stored behind, to the side of, or otherwise out of a comfortable reach range of the user. The devices comprise a housing, and at least one carriage retractable from the housing via a retraction assembly. Rapid access storage systems may comprise a wearable item, including hanging items, that include or are coupled to one or more rapid access storage devices.

20 Claims, 18 Drawing Sheets

(56) References Cited

U.S. PATENT DOCUMENTS

| | | | |
|---|---|---|---|
| 6,298,993 | B1 | 10/2001 | Kalozdi |
| 6,382,481 | B1 | 5/2002 | McIlmoil |
| 6,419,132 | B1 | 7/2002 | Reed et al. |
| 7,124,921 | B1 | 10/2006 | Hubbell |
| 7,240,404 | B2 | 7/2007 | Flossner |
| 7,334,712 | B2 | 2/2008 | Hassett et al. |
| 7,526,842 | B2 | 5/2009 | Wemmer |
| 8,438,811 | B1 | 5/2013 | Woodard et al. |
| 8,505,114 | B1 | 8/2013 | Earley |
| 8,627,514 | B1 | 1/2014 | Scoggins et al. |
| 8,720,833 | B2 | 5/2014 | Jack |
| 8,919,628 | B2 | 12/2014 | Jamlang |
| 8,919,629 | B2 | 12/2014 | Moreau et al. |
| 8,961,013 | B2 | 2/2015 | Bush |
| 9,074,840 | B2 | 7/2015 | Andersen |
| 9,078,503 | B1 | 7/2015 | Gilman |
| 9,212,000 | B1 | 12/2015 | McDonough |
| 9,510,661 | B2 | 12/2016 | Murdoch et al. |
| 9,629,446 | B2 | 4/2017 | Ty-Flot |
| 9,644,388 | B1 | 5/2017 | Ho et al. |
| 9,762,281 | B2 | 9/2017 | Moreau et al. |
| 9,820,556 | B2 | 11/2017 | Adams et al. |
| 10,058,164 | B2 | 8/2018 | Hanssen |
| 10,117,501 | B2 | 11/2018 | Marui |
| 10,130,160 | B1 | 11/2018 | Cheng et al. |
| 10,231,533 | B2 | 3/2019 | Vaughan et al. |
| 10,299,572 | B2 | 5/2019 | Salentine et al. |
| 10,308,301 | B2 | 6/2019 | Walk |
| 10,413,044 | B2 | 9/2019 | Husband |
| D881,793 | S | 4/2020 | Huang |
| 11,026,501 | B1 | 6/2021 | Dabrowka |
| 11,647,818 | B2 * | 5/2023 | Marquez ..... A45C 5/065 224/101 |
| 2002/0113102 | A1 | 8/2002 | Klamm |
| 2007/0080183 | A1 | 4/2007 | Lafoux et al. |
| 2007/0175941 | A1 | 8/2007 | Berry et al. |
| 2008/0251554 | A1 | 10/2008 | Hassett et al. |
| 2008/0302839 | A1 | 12/2008 | Murdoch et al. |
| 2010/0025560 | A1 | 2/2010 | Beck |
| 2010/0107861 | A1 | 5/2010 | Carter |
| 2012/0018478 | A1 | 1/2012 | Hanna et al. |
| 2012/0168472 | A1 | 7/2012 | Mathews |
| 2013/0181019 | A1 | 7/2013 | Salentine et al. |
| 2013/0193179 | A1 | 8/2013 | Davidson |
| 2013/0259405 | A1 | 10/2013 | Jack |
| 2016/0022016 | A1 | 1/2016 | Wolffe |
| 2016/0367021 | A1 | 12/2016 | Moreau et al. |
| 2016/0374407 | A1 | 12/2016 | Yagerman |
| 2019/0193985 | A1 | 6/2019 | Joyner |
| 2019/0200739 | A1 | 7/2019 | Green Mullins |
| 2021/0045509 | A1 | 2/2021 | Marquez |
| 2021/0253192 | A1 | 8/2021 | Walk |

* cited by examiner

SYSTEMS, DEVICES AND METHODS FOR STORAGE OF, AND RAPID ACCESS TO ITEMS

CROSS REFERENCE TO RELATED APPLICATIONS

This application is a continuation of U.S. patent application Ser. No. 16/993,768, filed on Aug. 14, 2020, which claims priority to U.S. provisional patent application Ser. No. 62/888,293, filed on Aug. 16, 2019, Ser. No. 62/888,936, filed on Aug. 19, 2019, and Ser. No. 62/889,477, filed on Aug. 20, 2019. This and all other extrinsic materials discussed herein are incorporated by reference in their entirety. Where a definition or use of a term in an incorporated reference is inconsistent or contrary to the definition of that term provided herein, the definition of that term provided herein applies and the definition of the term in the reference does not apply.

FIELD OF THE INVENTION

The field of the invention is storage of items and devices and systems for rapid access to stored items. More specifically, this disclosure relates to systems, devices and methods for allowing access to items stored behind or to the side of a user.

BACKGROUND

Backpacks, bags, tactical vests and other devices are effective for carrying or otherwise moving around with small or large amounts of goods. Many devices are worn or positioned behind wearers for convenience, comfort, or utility. Exemplary devices include backpacks, slings, tactical or other vests with compartments for carrying items, and wheelchair (or other seat) bags. While such devices allow users to move around with their essential items, it can be difficult to access items stowed in such devices without removing or repositioning the device. This can be problematic where there is a need to rapidly access stored items, or the user has difficulty contorting his body.

The present disclosure is directed toward one or more improved features identified below, and to devices and systems that address the above-mentioned problems.

SUMMARY

Rapid access and storage devices are disclosed herein. Contemplated devices can comprise a housing forming a cavity, the housing having a first side with an opening and a second side opposite the first side. At least one retraction assembly may be provided proximate the second side, each retraction assembly comprising a tensioner and a cord with the tensioner biasing the cord away from the opening toward the second side. A carriage can be coupled to the cord with a resting position within the cavity between the opening and the retraction assembly. The carriage can be configured to hold or store one or more items. For example, the carriage can have one or more of a fastener component, a pocket, and a compartment. The housing may comprise a funnel portion that is coupled to or formed by the opening. The funnel component can have a cross section that is larger, for example taller and wider, than a cross section of the cavity. The funnel portion can provide a larger opening for the carriage to be retracted back into the carriage without bumping into a wall of the housing.

The tensioner and the cord may be comprised of a single elastic cord. Alternatively or additionally, the tensioner may comprise a spring (e.g., a flat coil spring). As used herein, the term "cord" should be interpreted broadly to include a rounded cord, a flattened strap, or any other material suitable for a retraction assembly. Cords contemplated herein can have any suitable length. For example, a cord may have a length suitable to remain coupled to the carriage when the carriage is entirely removed from the housing cavity. Exemplary cord lengths include at least 12 inches, at least 18 inches, at least 24 inches, at least 30 inches, at least 36 inches, at least 42 inches, between 12-60 inches, between 24-48 inches, or between 48-96 inches. The cord may have a length that is greater than, at least twice the length of, at least three times the length of, at least four times the length of, or at least five times the length of at least one of a length of the carriage it couples to and a length of the cavity.

A coupling assembly may be used to provide a removably connection between the cord and the carriage, for example, quick release connectors, a buckle and clasp, a carabiner and carabiner receiver (e.g., a loop or metal ring), or any other suitable coupling assemblies.

An outer surface of the housing may comprise any number of fastener components that are complementary to fastener components of at least one of a wearable device, another rapid access storage device, or an item to be carried. For example, a first side of the outer surface may comprise a first set of fastener components (e.g., 1, 2, 3, 4, 5, or even more Molle stick fasteners, hook fasteners, loop fasteners), and a second side opposite the first side can comprise a second set of fastener components (e.g., 1, 2, 3, 4, 5, or even more Molle stick fasteners, hook fasteners, loop fasteners). The fastener components of the first side can be suitable for coupling the rapid access storage device to a wearable device. The fastener components of the second side can be suitable for coupling the rapid access storage device to another rapid access storage device. Where the housing comprises an outer covering (e.g., a fabric covering over a rigid or semi-rigid body), the outer surface of the housing can refer to the outer surface of the outer covering.

Rapid access storage systems are also disclosed herein. Contemplated systems comprise a wearable device and at least one rapid access storage device (e.g., 1, 2, 3, 4, 5 rapid access storage devices) as described above and throughout this application. As used herein, the term "wearable device" should be interpreted broadly to include items that can be worn or carried by a user (e.g., a backpack, a ruck sack, a tactical vest) or a device used by the user (e.g., a wheelchair). One or more of the rapid access storage devices can be removably coupled to an outer surface of the wearable device. One or more of the rapid access storage devices can be at least partially positioned within a compartment, recess or pocket of the wearable device and removably or permanently fastened thereto.

Other advantages and benefits of the disclosed system and methods will be apparent to one of ordinary skill with a review of the following detailed description.

BRIEF DESCRIPTION

The details of embodiments of the present disclosure, both as to their structure and operation, can be gleaned in part by study of the accompanying drawings, in which like reference numerals refer to like parts, and in which.

Figure 15B:
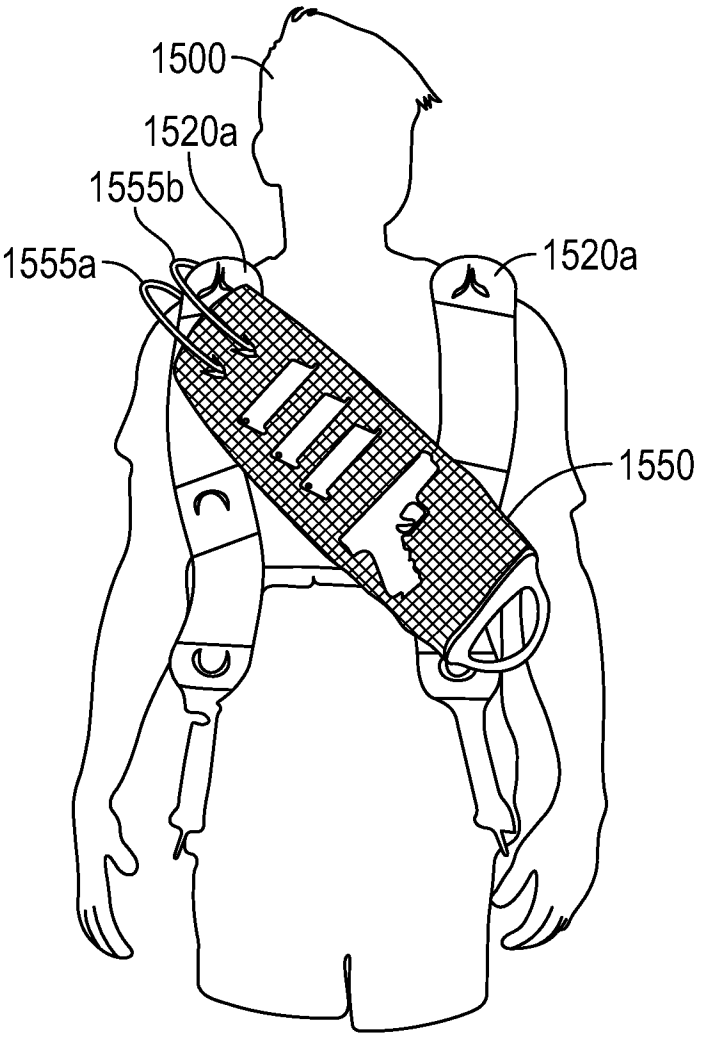
Figure 15A:
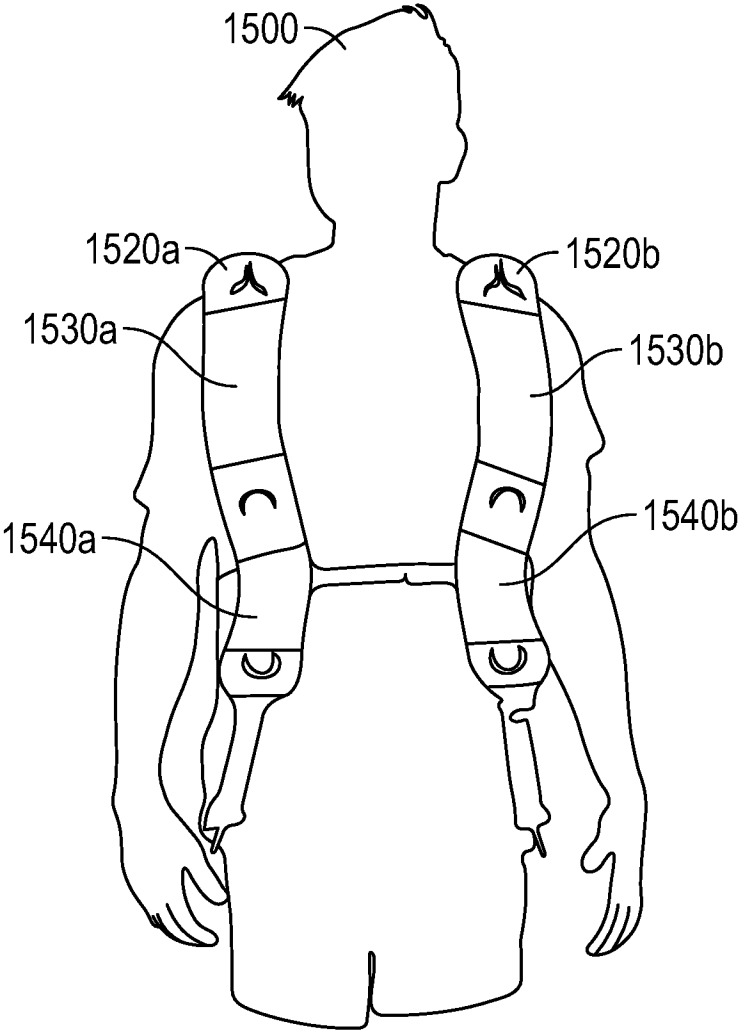
Figure 17:
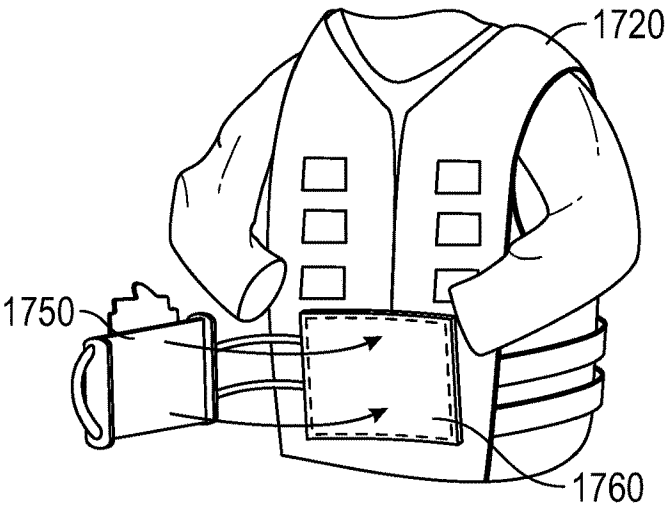
Figure 16:
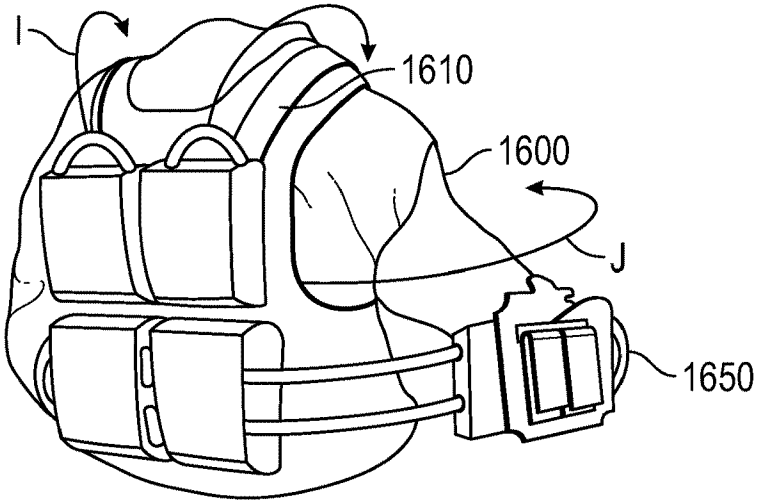
Figure 19:
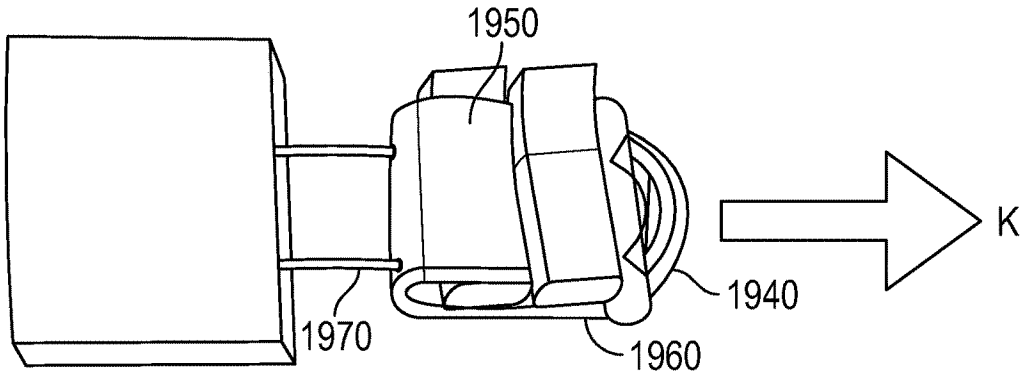
Figure 18:
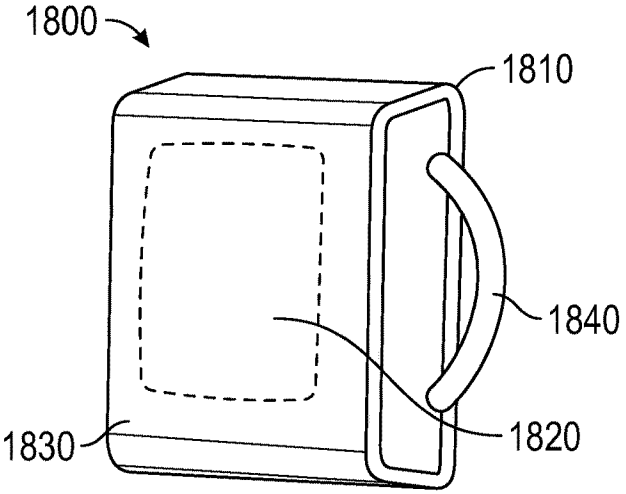
Figure 20A:
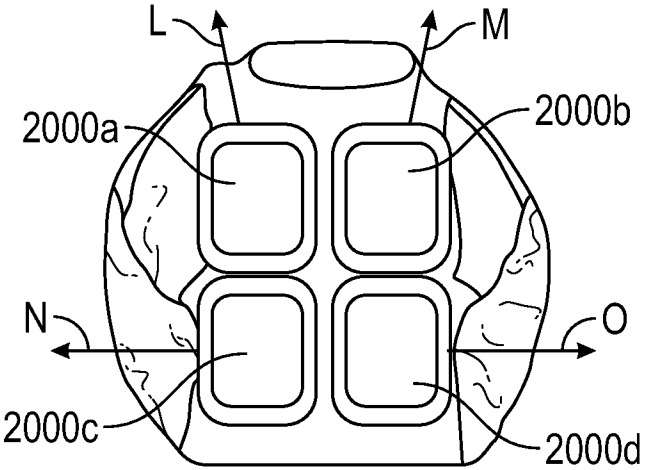
Figure 20B:
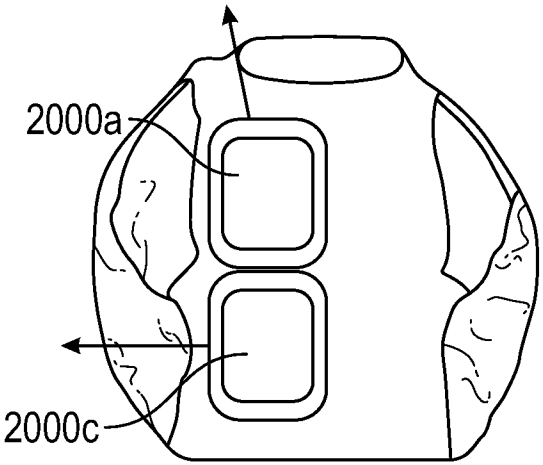
Figure 20C:
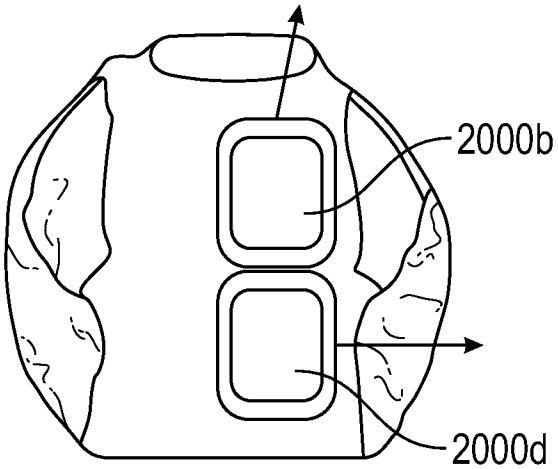
Figure 20D:
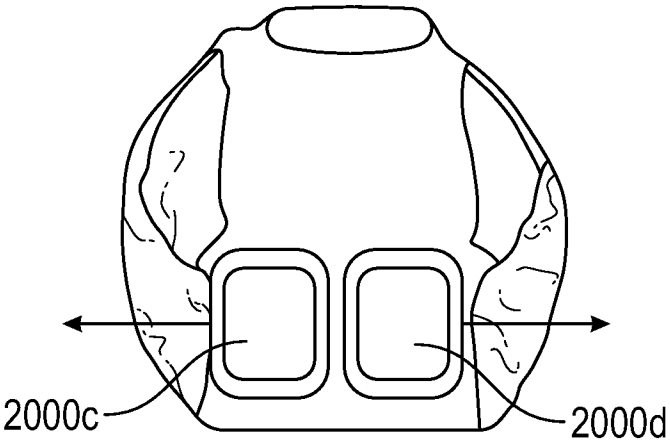
Figure 21:
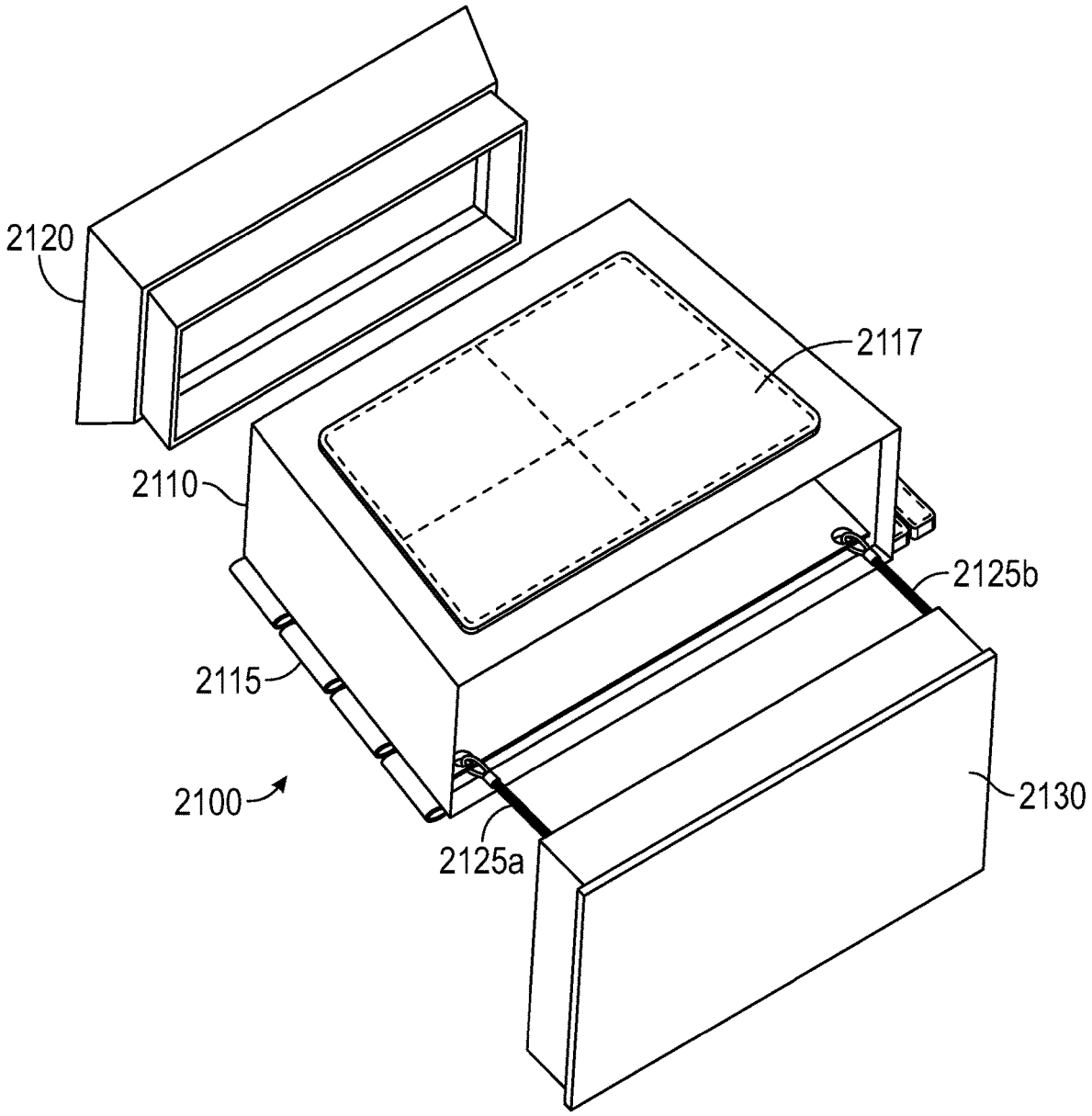
Figure 22:
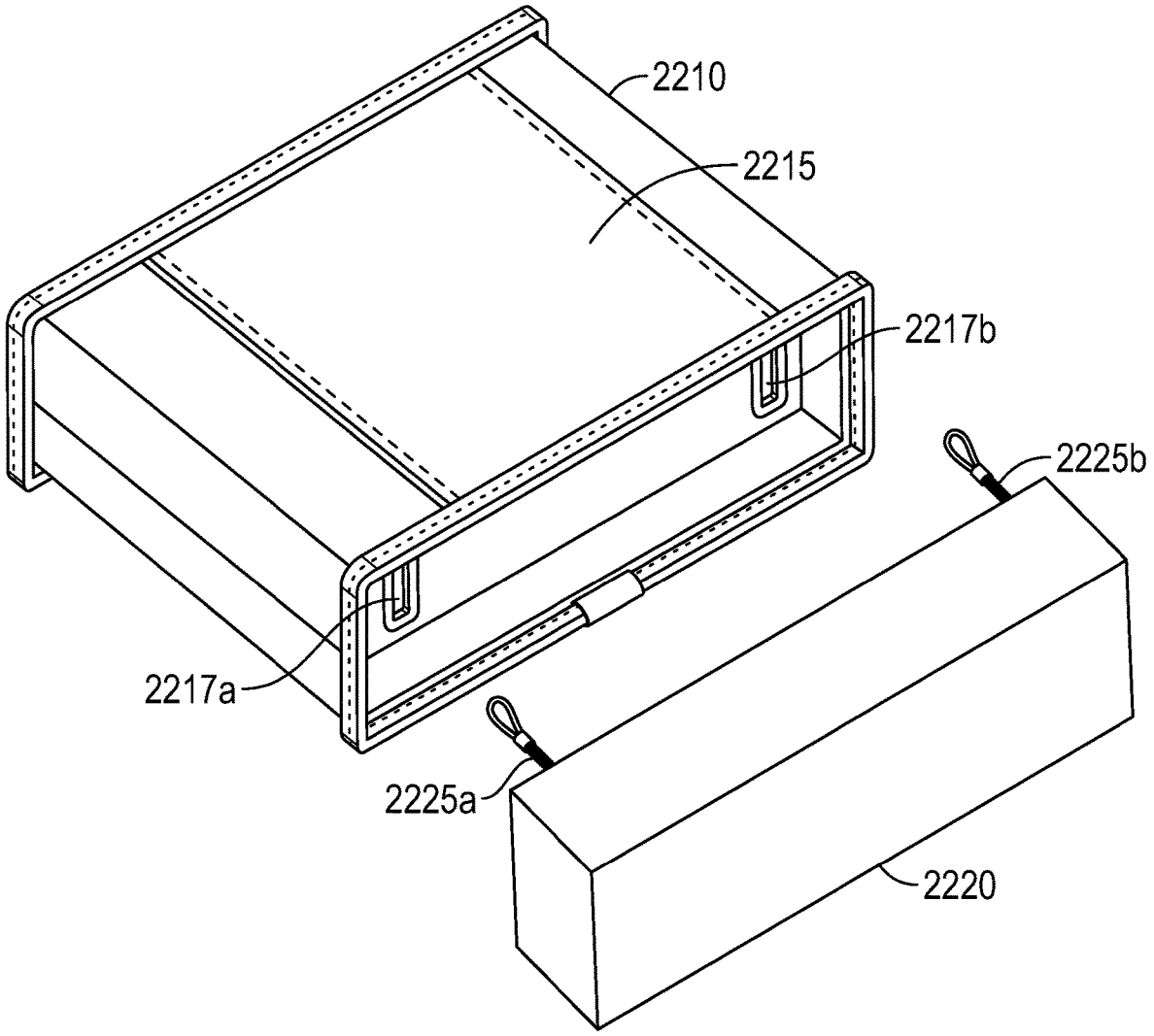
Figure 23:
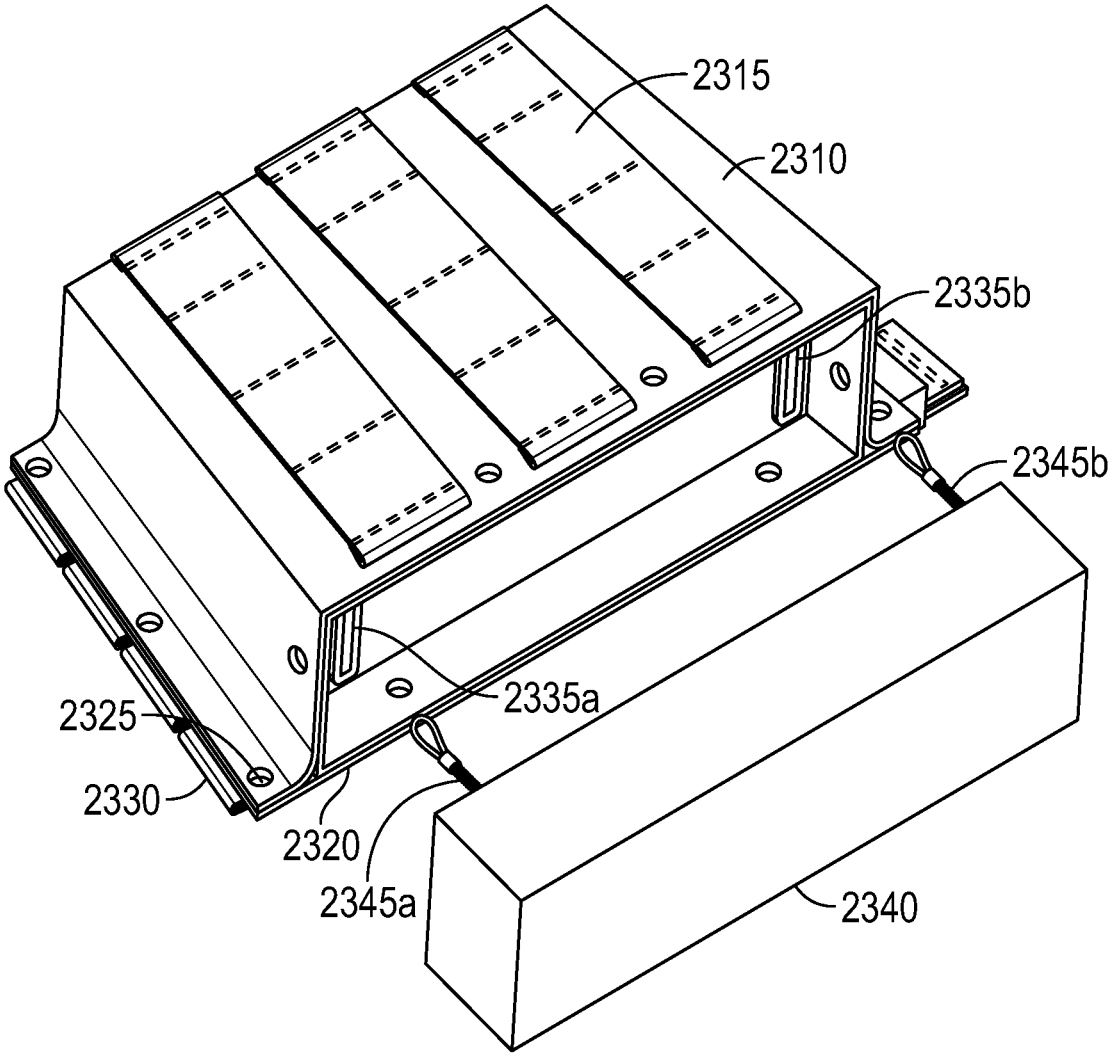
Figure 24:
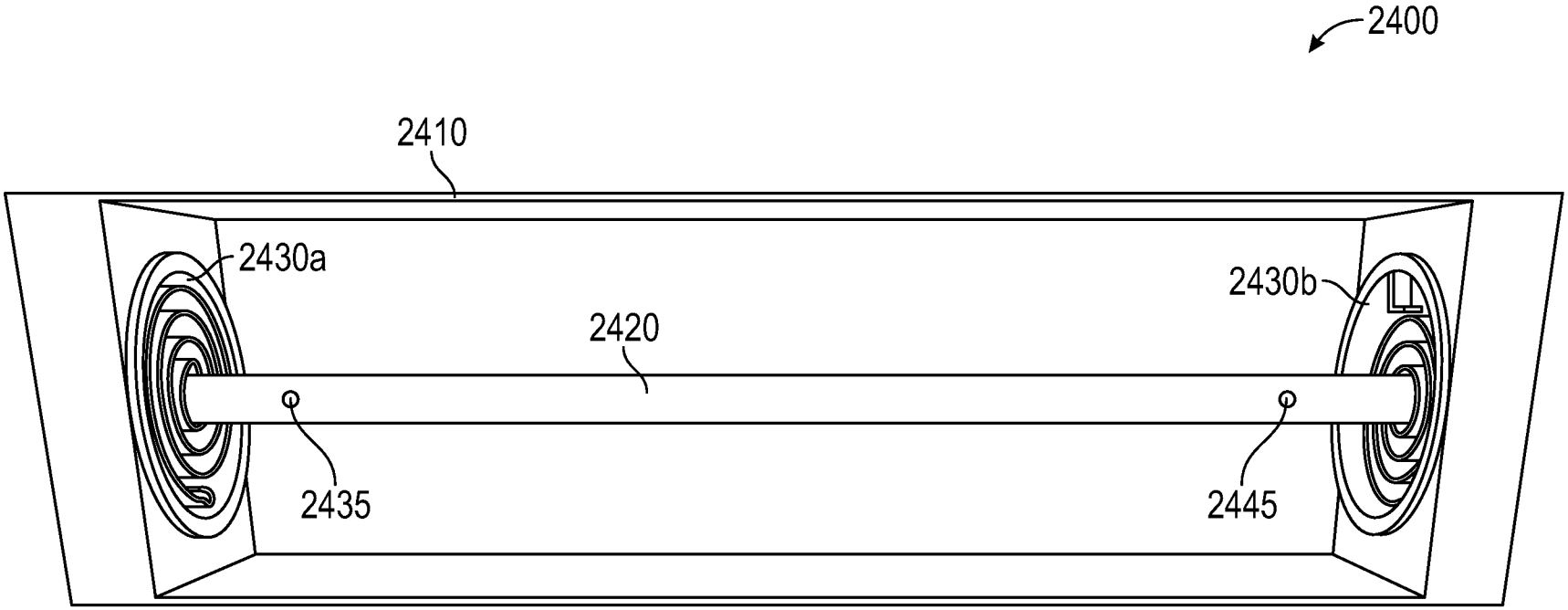

FIGS. 14A-D illustrate another embodiment of a rapid access storage system;

FIGS. 15A-B illustrate a rapid access storage system worn and used by a wearer;

FIG. 16 illustrates rapid access storage devices on a tactical vest;

FIG. 17 illustrates a rapid access storage device on a tactical vest;

FIG. 18 illustrates a rapid access storage device;

FIG. 19 illustrates a rapid access storage device with a carriage pulled away from housing;

FIGS. 20A-D illustrate rapid access storage devices on tactical vests;

FIG. 21 illustrates a rapid access storage device with a single retraction assembly;

FIG. 22 illustrates another rapid access storage device with a single retraction assembly;

FIG. 23 illustrates another rapid access storage device with a single retraction assembly;

FIG. 24 illustrates a portion of an embodiment of a retraction assembly.

DETAILED DESCRIPTION

The detailed description, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation.

The present disclosure is directed to rapid access and storage devices and systems. Contemplated devices comprise a housing forming a cavity and having an opening, a carriage sized and dimensioned to be at least partially, substantially or entirely contained within the housing and configured to store one or more objects, and one or more retraction assemblies coupled to the carriage via a coupling assembly. The retraction assemblies may be positioned proximately a side of the housing that is opposite the opening. The carriage can be selectively pulled out from the housing via the retraction assembly. The carriage may include or be coupled to a handle to assist users in retracting the carriage from the housing and towards an area of comfortable reach for the user. Once the desired items are retrieved from the carriage compartment, the user can release the handle to cause or allow the carriage to retract back into the housing. The coupling assembly can be used to release the carriage from the retraction assembly when desired.

The retraction assembly may comprise a tensioner and a cord. The cord can comprise a length of cord, a strap, an elastic member such as a bungee, or any other suitable length of material(s). Where the cord is elastic, the cord can act as the tensioner. The length of cord can be pulled away from the housing and be biased to retract back into the housing, for example, with the carriage it is coupled to. The cord can include or be coupled with a coupling component that is a component of a quick release or other coupling assembly. The carriage can include or be coupled to a complementary component of the quick release or other coupling assembly.

A funnel component may be coupled to an opening of the housing and comprise an opening portion that is larger than the cavity of the housing, the opening of the housing, and a side portion of the carriage that first enters the housing cavity when retracted back into the housing cavity (e.g., upon release of a carriage handle by a user). Additionally or alternatively, an opening of the housing can comprise a funnel portion such that the carriage can retract into the housing cavity without bumping into or being blocked by a side wall or other portion of the housing when retracted in a manner that is not perfectly aligned with the housing cavity.

The housing may comprise or be coupled to a fastener component for removably coupling the housing to a fastener component of a wearable device. Additionally or alternatively the housing may comprise or be coupled to strap(s) for coupling the housing to at least one of a person's body and a chair.

It should be appreciated that each rapid access and storage system can comprise any suitable number of carriages, retraction assemblies, funnel components, funnel portions, cords or other components, and that each of the components can comprise any suitable shape or shapes. It should also be appreciated that the housing (e.g., an outer surface of the housing) can comprise any suitable number of fastener components to fasten with fastener components of wearable devices, other rapid access and storage devices, or other objects.

The following includes description of various features and characteristics of the devices and system of the inventive subject matter. The skilled person will readily understand that various features described below can be readily combined with one another even though not explicitly described as such.

Figure 1:
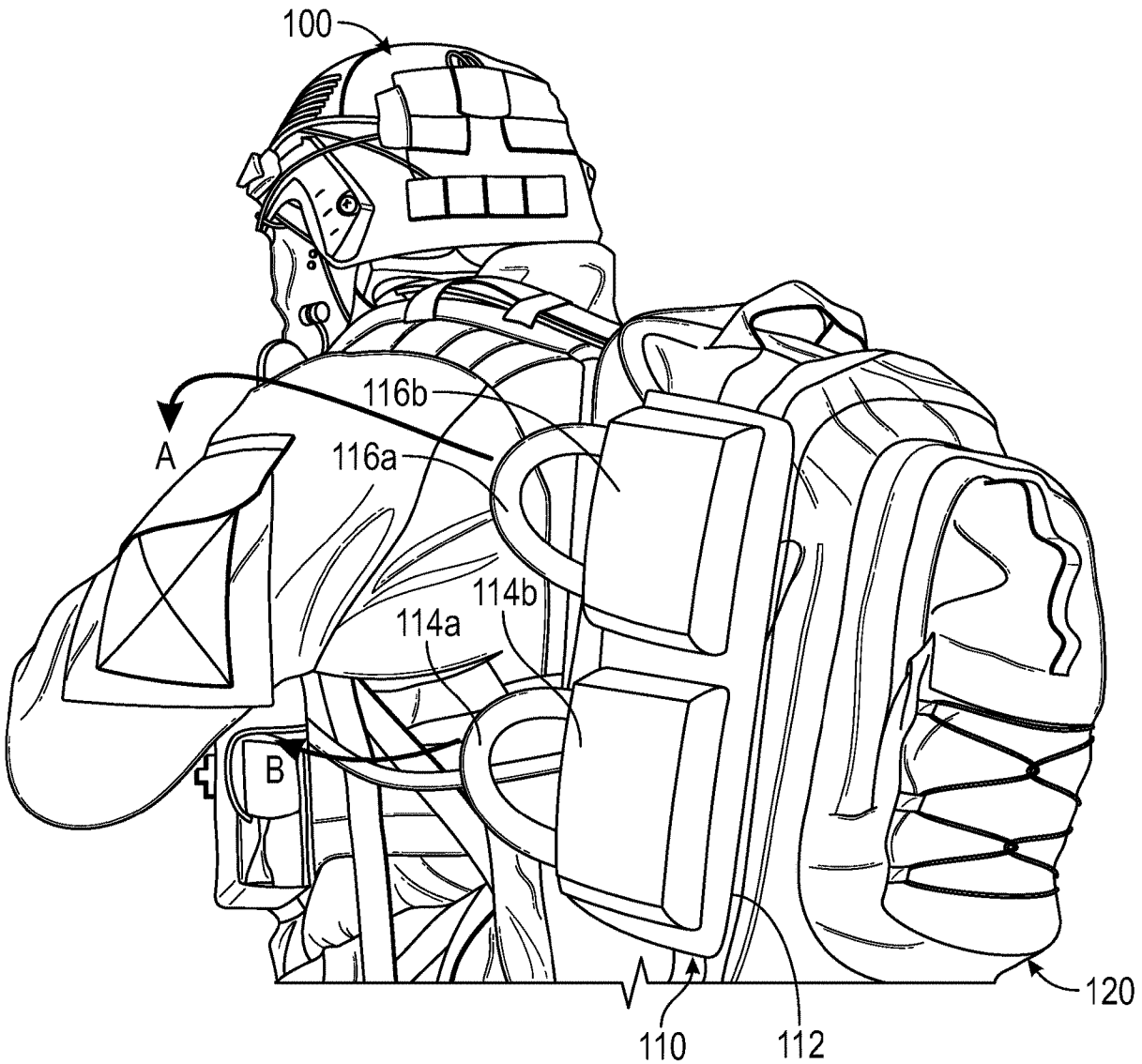
FIG. 1 illustrates an embodiment of a rapid access storage system.

FIG. 1 illustrates an embodiment of a rapid access storage system of the inventive subject matter worn by user 100. User 100 is wearing a backpack 120 as a wearable device. The backpack 120 is used as an example herein, but is not limiting to the disclosure as described in the following. The backpack 120 can be virtually any wearable device, including any bag, ruck sack, or other storage element used to carry equipment. The backpack is removably coupled to a set of rapid access storage devices 110 via a fastening or attachment assembly 112. User 100 can retrieve carriages (not visible in this view) out from within housings 114*b*, 116*b* of the rapid access storage devices via handles or retrieval loops 114*a*, 116*a*, respectively. User 100 can bring the carriages towards the front of the wearer for easy access in directions A and B. Direction A is around a shoulder of the user 100, and direction B is around the waist or torso of the user 100, although it is contemplated that the rapid access and storage devices can be positioned with handles 114*a*, 116*a* in any suitable orientation to allow the user 100 to pull the handle in any suitable direction. The cord of each retraction assembly as further described below can allow the user to pull the carriage at least 1 foot, at least 2 feet, at least 3 feet, at least 4 feet or even farther away from the housing. The pulling can be enabled via at least one of a length and elasticity of the element.

Two rapid access and storage devices are shown in FIG. 1. However, it should be appreciated that a rapid access and storage system can comprise any suitable number of devices (e.g., at least 1, at least 2, at least 3, at least 4, at least 5, at least 8) positioned along an outer surface of, or within pockets/recesses of, the wearable device. Two or more of the devices may be part of a set sharing a base element. Viewed from another perspective two or more devices may be permanently or removably coupled to a base element, and the base element can comprise one or more fastener components that removably couples with one or more fastener components of the wearable device (e.g., a hook and loop fastening assembly, MOLLE style clip or stick fastener and sleeves/grids for receiving such fasteners). It is also contemplated that the systems described herein can be modular such that the rapid access and storage devices could be used with more than one wearable device, and that a wearable device can be used with various different rapid access and storage devices. Further, the rapid access storage devices can be modular such that a retraction assembly and housing of a device can be used with different interchangeable carriages.

Figure 2:
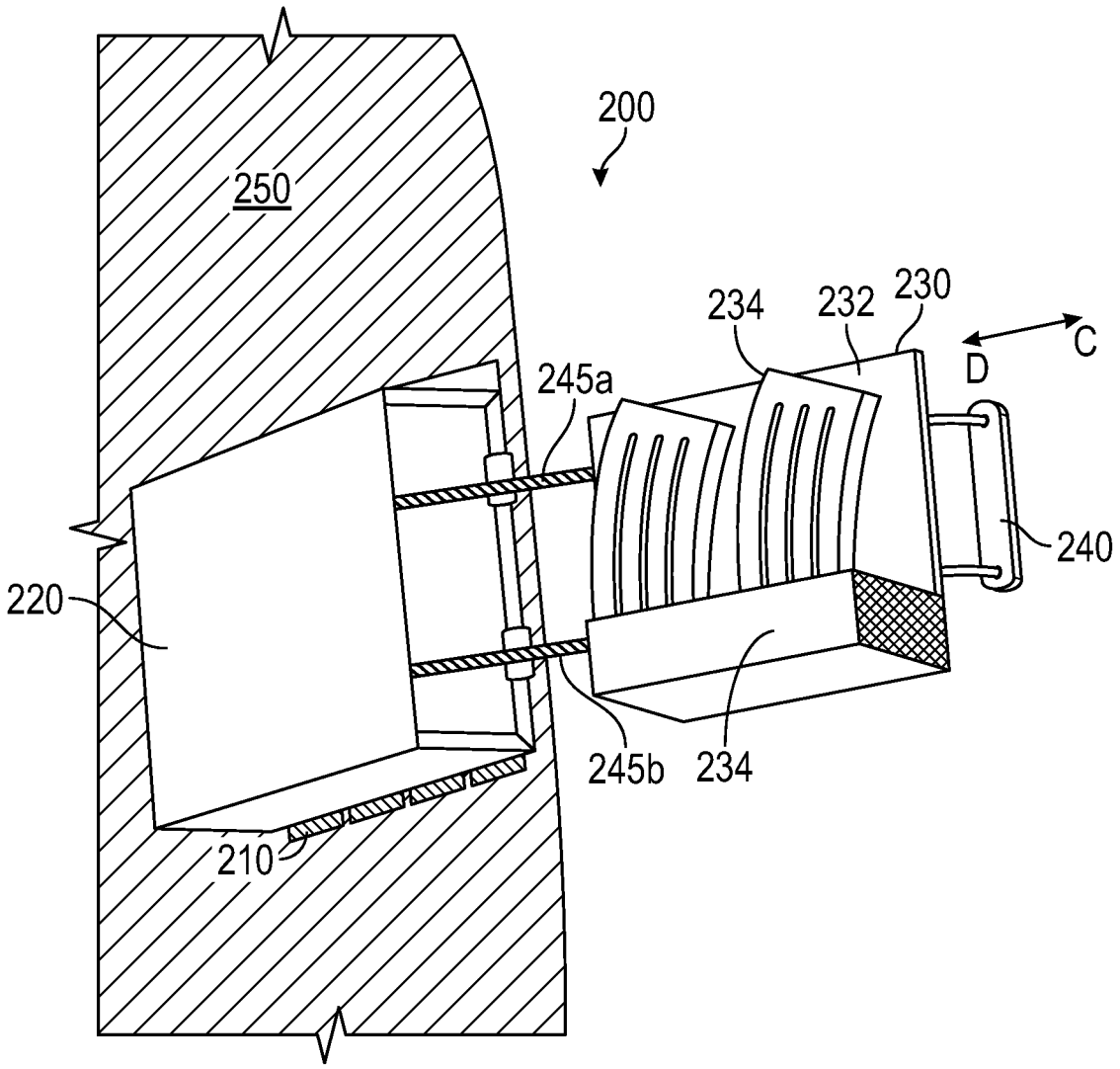
FIG. 2 illustrates an embodiment of a rapid access storage device.

FIG. 2 is a graphical depiction of rapid access and storage device 200, which may be incorporated into a set or system as described herein (e.g., the system of FIG. 1). The device 200 can have a housing 220. The housing 220 can include a rigid or semi-rigid body. The housing 220 can be formed of various materials depending on use and need of the end user. In some implementations, the housing 220 can be formed from ABS plastics, fiber reinforced plastic (FRP), carbon fiber, various plastic, honeycomb, or hex-cardboard materials, to name just a few examples. Such a structure can allow for some varying levels of flexibility and strength. A rigid structure can be beneficial, for example, in the event there is weight applied to the outside of the wearable device 250 coupled to the rapid access and storage device. For example, if the user is on his back and needs to access the contents of the device 200, pressure exerted on the outside of the housing 200 will not prevent retrieval of the carriage 230 or the items 234 stored in compartment 234 of carriage 230. This would be particularly beneficial in a warfighting scenario. In other embodiments, such protections may not be necessary and a semi rigid or flexible construction may be more beneficial and potentially lighter weight.

The housing 220 can have a fabric or other outer covering, which may be permanently or removably coupled to the rigid or semi rigid body. The housing 220 (e.g., outer cover of housing) can have or be coupled with one or more fastener components or assemblies 210. The fastener components 210 can include strap-and-loop-type connectors such as MOLLE or Slickstick™ connectors. The fastener component 210 can use other connector styles such as a hook or loop fastener, or a snap fastener. The fastener component 210 can be used to couple the device 200 to corresponding and complementary Slickstick/MOLLE or other fastener components (e.g., openings, sleeves (or PALS/MOLLE grids), hook or loop fastener, snap components) on a surface of a wearable device 250, another rapid access and storage device, or other object. The surface can be a side, back, top or any other portion of the wearable device 250.

The device 200 can have a carriage 230. The carriage 230 can have a rigid, semi-rigid or flexible structure having a panel portion 232. The carriage 150 can further have one or more compartments 234. The panel portion 232 and the compartment 234 can contain or hold items desired by the user. For example, in a war fighter scenario a user may store ammunition or other items 234 in the carriage 234, as shown. Two magazines are shown in the compartment 234 of the carriage 230 in FIG. 2.

It is contemplated that carriage 230 can have any number of compartments and fastener components, to carry multiple magazines or other items such as med packs, a side arm, or various items depending on mission load and personal preference for civilian use (e.g., wallet, medicine, personal items). The compartments can be flexible (e.g., pockets) or rigid as needed for an application. In some other embodiments, the panel portion 232 can have hook or loop or other fastener components that allow quick stowage and retrieval of items not contain directly within the compartment 234. The items may include complementary fastener components to the carriage fasteners.

The carriage 230 can be coupled to the housing 220 via one or more cords of retraction assemblies having portions 245*a*, 245*b*. The cords can be a portion of one or more retraction assemblies coupled to the housing 220 and retract the carriage 230 within the housing 220 (e.g., in direction D), and allow the carriage to be retrieved by the user via handle 240 (e.g., in direction C) while connected to the housing via the cords. The retraction assembly may comprise a tensioner that biases the carriage it is coupled to (via the cord(s)) to be within the housing cavity. The retraction assembly may include any of the retraction assemblies described in connection with FIGS. 3-8, 14B, 21-24 below, or any other suitable retraction assemblies. The housing may include a funnel portion as described in FIG. 3.

Figure 3:
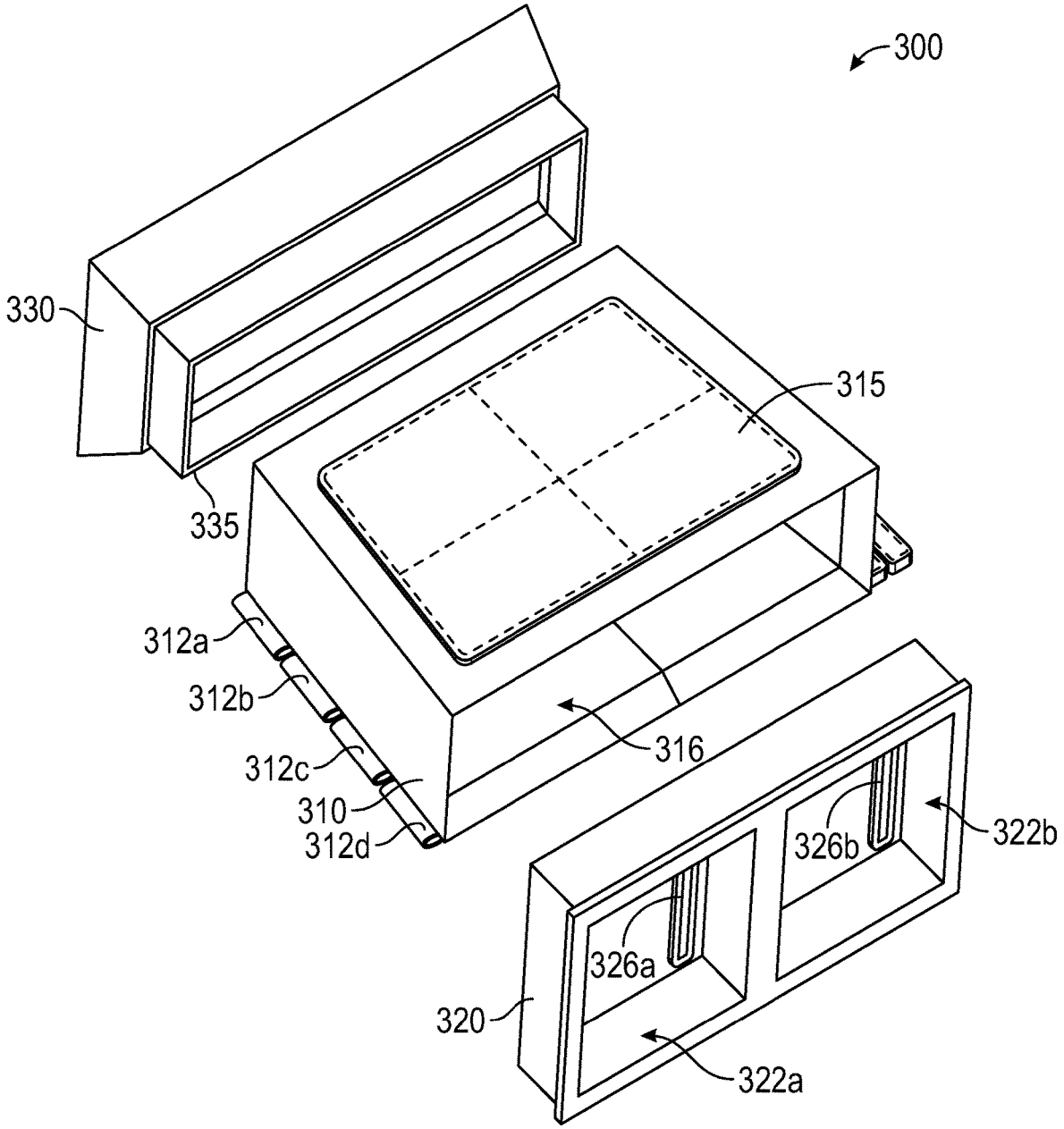
FIG. 3 illustrates an exploded view of a housing of a rapid access storage device.

FIG. 3 illustrates an exploded view of a housing of a rapid access storage device (which can be a rapid access storage device shown in FIG. 1, among other Figures and embodiments). Housing 300 includes a main body portion 310, a funnel component or funnel portion 330, and a retraction assembly end portion 320. The main body portion 310 comprises two open ends that are sized and dimensioned to couple with funnel component 330 and retraction assembly end portion 320. The main body portion 310 comprises an opening and forms cavity 316. The main body portion 310 further comprises a set of fastener components 312*a*, 312*b*, 312*c*, 312*d* (e.g., MOLLE fasteners), and an attachment surface 315 made of a hook or loop material or other fastener component (e.g., snaps), which can removably couple with fastener components of other objects (e.g., other rapid access and storage devices). The main body portion 310, the funnel component 330 and the retraction assembly end portion 320 can be a generally rigid or semi-rigid structure. The retraction assembly end portion 320 can have one or more recesses 322*a*, 322*b*, formed to receive a corresponding retraction assembly (shown in FIG. 6). Two recesses are shown and labeled 322*a*, 322*b*. However, any suitable number of recesses can be provided. The retraction assembly or assemblies can include cord(s) that pass through openings 326*a*, 326*b*, and are attached to or removably coupled with one or more carriages positioned within opening 316. Additionally or alternatively, the retraction assembly or assemblies can act as an end portion of housing and include openings for cords or other elements to pass through and couple with one or more carriages. Additionally or alternatively the retraction assembly can be positioned proximate to a second side of the housing opposite a first side comprising the opening. The retraction assembly or assemblies can allow a user to pull the carriage away from within the housing while staying connected to the housing to retrieve an item, and pull the carriage back into the housing when released by the user.

The funnel component 330 (or funnel portion of housing) can have a mouth wider than the opening provided in the main body portion 310. The mouth can also be wider and taller than a side of the carriage that enters the housing when released by a user. In some implementations the funnel component 330 can serve as a feed funnel, providing about a 0.1-2 inch, about 0.1-1 inch, about 0.25-0.75 inch of an outer perimeter lip or outer edge of which the opening will have an outward slant. The outward slant could be angled relative to a second portion 335 of component or housing main body portion 310 surfaces at between 20-80 degrees, between 30-70 degrees, between 35-65 degrees, between 35-45 degrees, or any other suitable angle. This can provide for a wider opening to allow the smaller carriage (e.g., carriage 230 of FIG. 2) to be retracted and received into the housing 110 with ease. The carriage is sized and dimensioned to be held entirely or partially within main body portion 310. The funnel component or portion can prevent the carriage from snagging or bumping into a portion of the housing 300 or otherwise being obstructed when released by the user and retracted by the retraction assembly into the cavity of housing.

The funnel component 330 and retraction assembly end portion 320 (or retraction assembly when it acts as an end portion of housing) can be coupled to main body portion 310 in any suitable matter. For example, second portion 335 of funnel component 330 could be sized and dimensioned to snugly fit within opening 316 at a first end, and a portion of retraction assembly end portion 320 could be sized and dimensioned to snugly fit within opening 316 at a second end opposite the first end. A glue or other adhesive could optionally be used to attach the second portion of funnel component 330 and the portion of the retraction assembly end portion 320 to an inner surface of main body portion 310. It is also contemplated that the second portion of funnel component 330 and the portion of the retraction assembly end portion 320 could be sized and dimensioned to snugly fit around an outer surface of main body portion 310, and the glue or other adhesive could optionally be used to attach the second portion of funnel component 330 and the portion of the retraction assembly end portion 320 to an outer surface of the main body portion 310.

Figure 4:
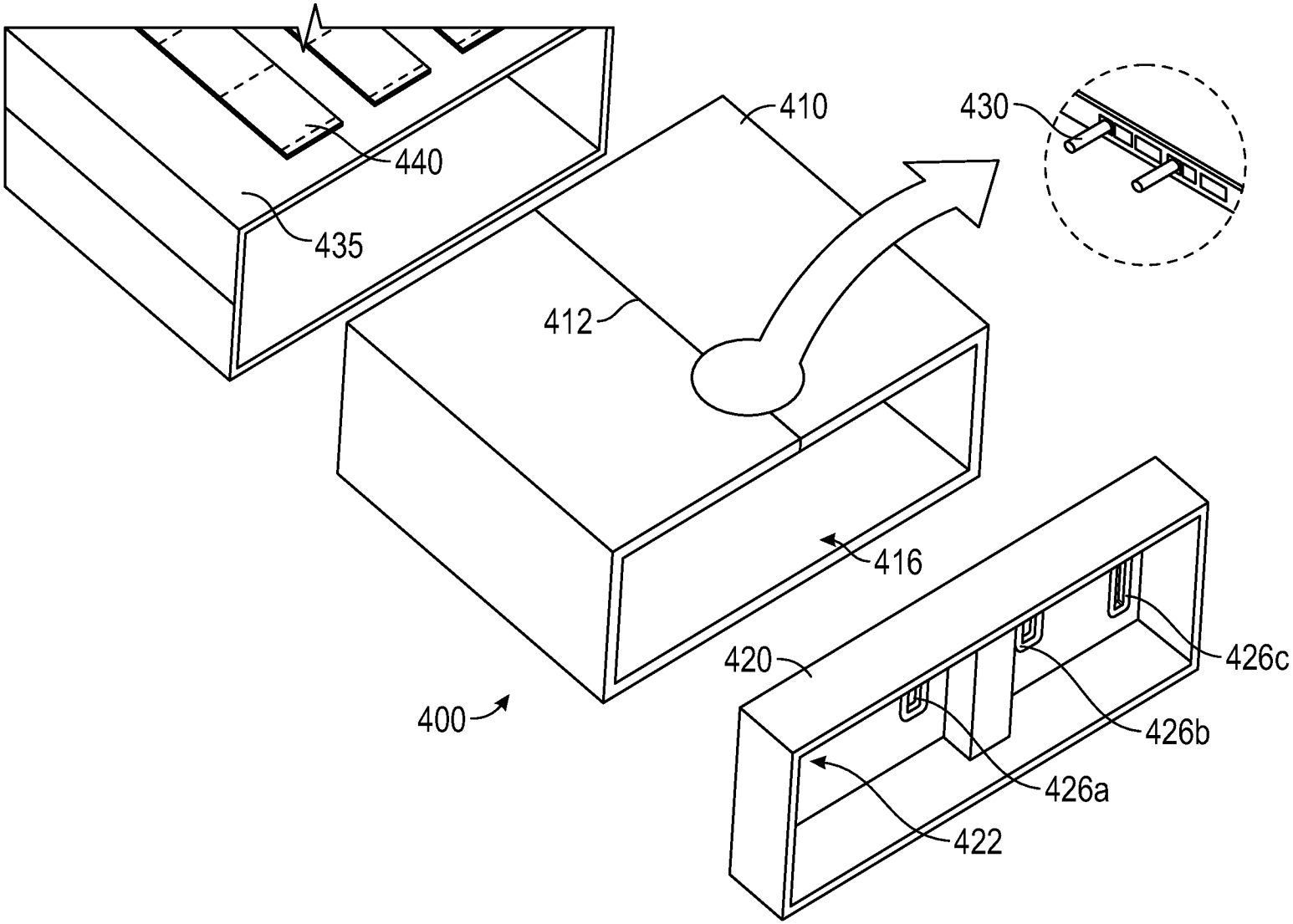
FIG. 4 illustrates an exploded view of another housing of a rapid access storage device.

FIG. 4 illustrates an exploded view of another housing of a rapid access storage device (which can be a rapid access storage device shown in FIG. 1, among other Figures and embodiments). In some embodiments the housing 400 can have a body portion 410. The body portion 410 can be molded plastic, metallic, or cast material providing varying levels of flexibility and strength. The body portion 410 can be formed or molded into a unitary component defining the housing. The housing 400 can further have a first end portion 420 similar to the retraction assembly end portion of FIG. 3, and optionally a funnel portion or funnel component. The housing 400 can further have an outer covering 435. The outer covering 435 can be a fabric covering such as canvas, Cordura™, or other resilient fabric. The outer covering 435 can further have one or more fastening assemblies 440. In the example shown in FIG. 4, a set of MOLLE style fasteners (e.g., sticks or clips) are provided. Body portion 410 comprises two open ends and a cavity 416 with one open end closed by retraction assembly end portion or one or more retraction assemblies. Body portion 410 may be formed of a piece of material bent to form a rectangular cross-section. Two edges of the material may be joined together via fasteners such as steel pins 430 at a joint 412, via hook or loop fastener components (e.g., on overlapping edges), snaps, clips, clasps, or any other suitable fastener. Where provided, the steel pins can help support the seam for strength and durability to support the weight of a person falling on the device and system. This can ensure that a user can pull out the contents of the device/carriage even after a lot of pressure has been applied to the device.

First end portion 420 comprises a one or more recesses 422 sized and dimensioned to hold one or more retraction assemblies, and a set of openings (e.g., 426*a*, 426*b*, 426*c*) through which a coupling mechanism or cord of the retraction assemblies can pass through such that it extends from the one or more recesses 422 to within cavity 416 of body portion 410. Any suitable retraction assembly or assemblies may be placed within recesses 422, including for example the retraction assemblies shown in FIGS. 6 and 23. In some embodiments, an outer cover (e.g., cap or nylon/fabric flap with fastener component) may be placed around the retraction assemblies once placed within recesses 422 of first end portion 420. Any suitable carriage, including for example the carriages shown in FIGS. 2, 14D, and 19 may be coupled to the retraction assembly or assemblies, and housed within body portion 410.

Figure 5:
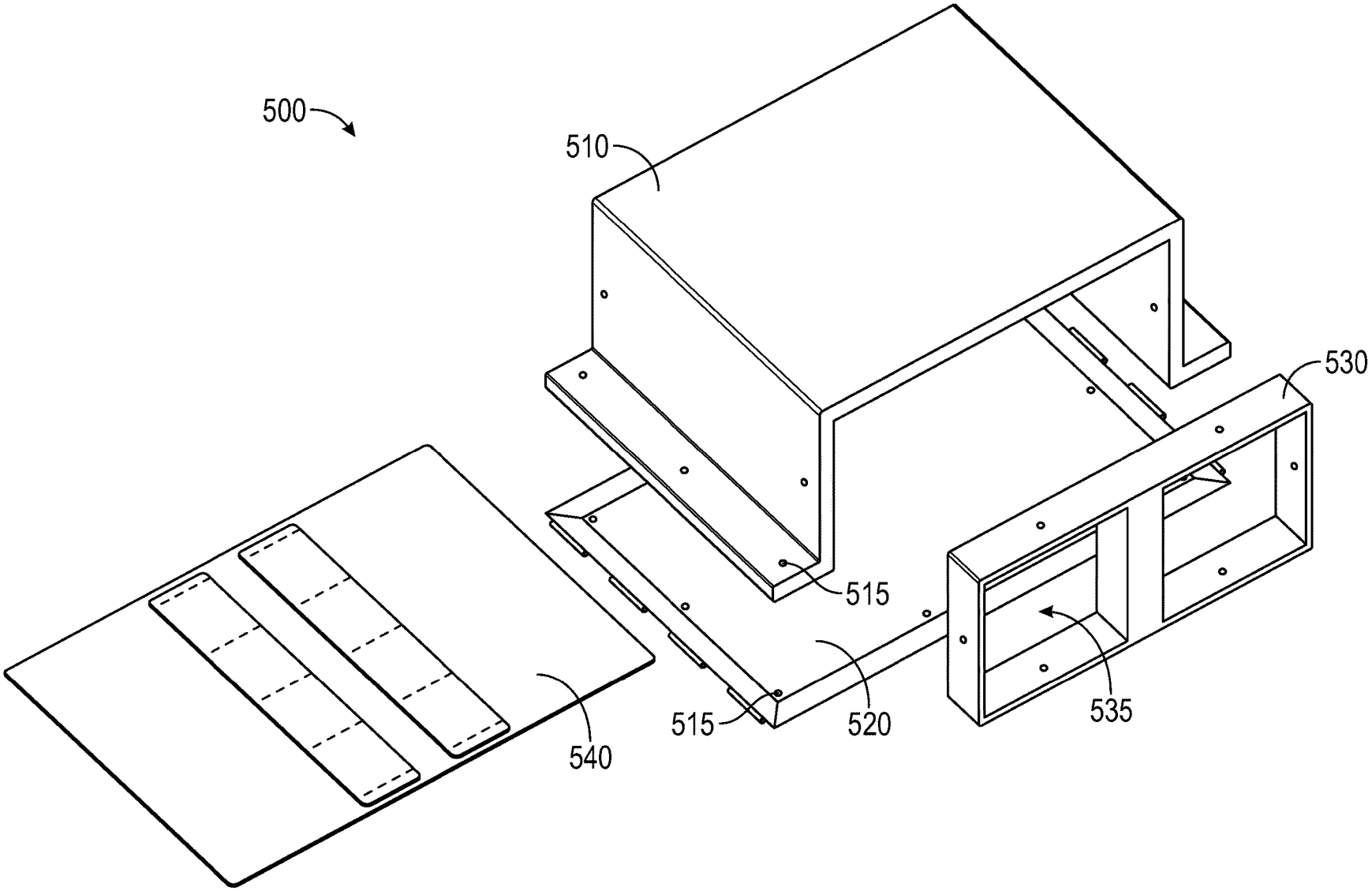
FIG. 5 illustrates an exploded view of another housing of a rapid access storage device.

FIG. 5 illustrates an exploded view of another housing of a rapid access storage device (which can be a rapid access storage device shown in FIG. 1, among other Figures and embodiments). In some embodiments the housing 500 can be formed of a platform 520 coupled to bent portion 510 having two side walls, an upper wall, and two flanges that extend from the side walls. The platform 520 can be coupled to the bent portion 510 via a series of fasteners such as rivets received through fastener receivers 515. The platform includes a set of fastener components on a bottom surface (e.g., a set of MOLLE stick fasteners), which can removably couple with fastener components (e.g., MOLLE grid) of a wearable device 540 or other object. As shown, each of the MOLLE fasteners can slide through sleeves created by fastener components of wearable device 540, and fasten to itself (e.g., via a snap mechanism). The housing 500 can further have a retraction assembly end portion 530 similar to those described above that can receive one or more retraction assemblies within recesses 535. The flanges of bent portion 510 comprise fastener receivers (e.g., rivets 515) that align with fastener receivers 515 of platform 520. Bent portion 510 and platform 520 can further include fastener receivers (e.g., on side walls of bent portion) that align with fastener receivers of retraction assembly end portion 530, which allows the components to be coupled to one another via screws, rivets, or other fastener components. Additionally or alternatively, an adhesive such as glue could be used to fasten the bent portion, platform and retraction assembly end portion to one another.

While the components herein (housing, carriage, cord, retraction assemblies, retraction assembly end portion, wearable devices) are described generally as being removably coupled to one another, for example, to provide for modular devices and systems, it is also contemplated that two or more components can be permanently affixed or bonded to one another (e.g., via an adhesive).

Figure 6:
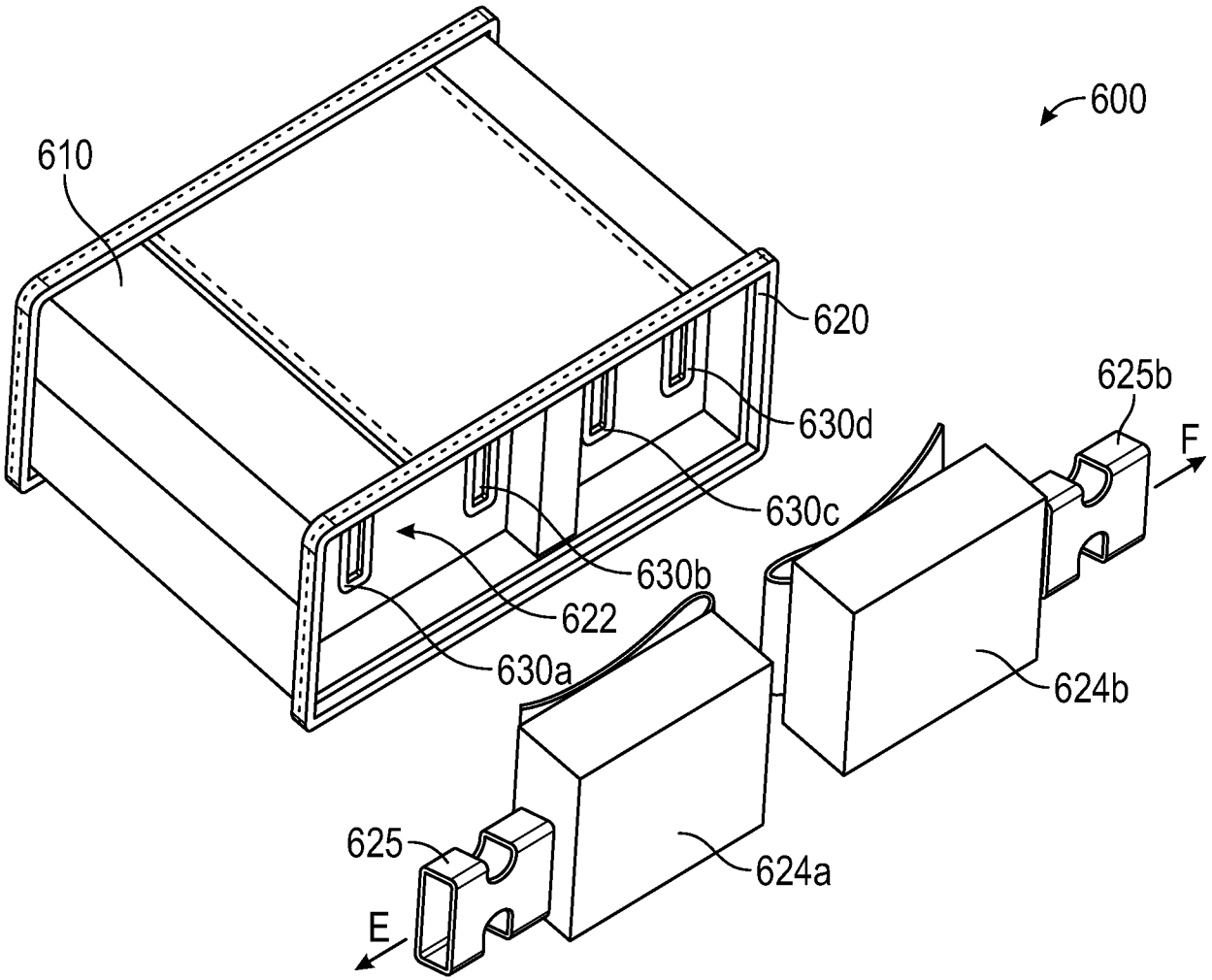
FIG. 6 illustrates an exploded view of another housing of a rapid access storage device.

FIG. 6 is a perspective view of a rapid access and storage device 600. One or more carriages are positioned within the housing 610 and not shown. The housing 610 includes a retraction assembly end portion 620, which can receive one or more retraction assemblies 624*a*, 624*b* within one or more recesses 622. Two retraction assemblies 624*a*, 624*b* are shown exploded from the device 600. Each retraction assembly 624*a*, 624*b* can comprise a tensioner (e.g., an elastic member, a spring) and a length of cord (e.g., cords 730*a*, 730*b* of FIG. 7). Each retraction assembly 624*a*, 624*b* can be, for example, similar to a high force key retractor having a high retraction force. Where the retraction assembly comprises a cord, the cord can be a lightweight rope with a high break strength such as Vectran, Dyneema, Kevlar, or other similar cordage. For example, the retraction assembly can comprise a 12 oz retraction force with an 80 pound break strength. The cord(s) can comprise any suitable length, including for example, at least 12 inches, at least 18 inches, at least 24 inches, at least 36 inches, or at least 42 inches. The retraction assemblies 624*a*, 624*b* can further have a quick release connector 625, 625*b* (or other connector) coupled to the cord, band or other retraction element for connecting and disconnecting the retraction assembly to the carriage. The carriage can include or be coupled to one or more quick release or other connector that are complementary to, and fasten with, the quick release or other connectors 625, 625*b* of retraction assemblies 624*a*, 624*b*.

Retraction assembly end portion 620 comprises a set of openings 630*a*, 630*b*, 630*c*, 630*d*, which the cords and connectors 625, 625*b* can extend through to couple with carriage positioned within a cavity of housing 610. For example, end portion 620 can comprise two openings (for the cords/connectors of two retraction assemblies), four openings (two for the cord/connectors of two retraction assemblies, and two for fasteners of the two retraction assemblies to pass through (e.g., metal clips, or fabric strip that extends through an opening and fastens to an inner surface of the housing 610, for example via hook and loop), or any other suitable number of openings. Quick release connectors 625, 625*b* and the cords can be pulled in directions E and F or any other suitable directions. Although connectors 625, 625*b* are illustrated as extending from left and right sides of retraction assemblies 624*a*, 624*b*, it should be appreciated that connectors 625, 625*b* (and cords) could extend from the retraction assembly body at any position (e.g., in a direction facing the set of openings). It is also contemplated that retraction assemblies 624*a*, 624*b* can comprise fastener components (e.g., a steel clip or fabric loop with fastener) that can mate with one or more of the openings or other portions of device 600 for securement with retraction assembly end portion 620.

A user can pull a handle of a carriage, and exert a force sufficient to pull the carriage from the housing, and against the retraction assemblies 624*a*, 624*b*. The user can retrieve or stow necessary items from/in the carriage. The user can then release the handle, and the reeling assemblies 624*a*, 624*b* can retract the carriage back into the housing 610.

In some examples, the reeling assemblies 624*a*, 624*b* can also have a pull-to-retract arrangement, in which the user pulls the handle to retrieve the carriage; the cords (or bands) remain extended until the user again puts the cords under a slight amount of tension to then reactivate the reeling assemblies 624*a*, 624*b*. The carriage is then retracted within the housing 610.

Figure 7:
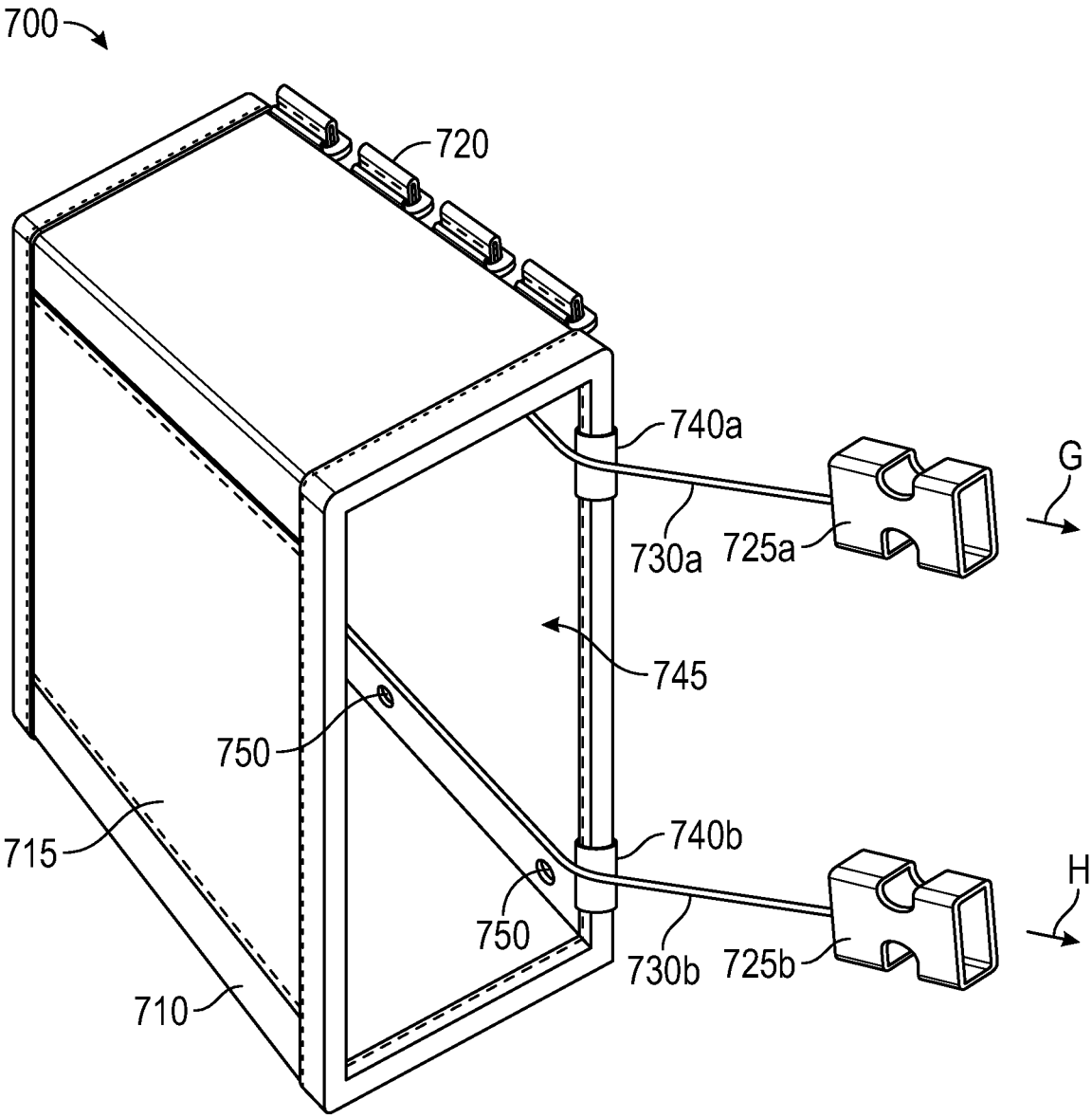
FIG. 7 illustrates a housing of a rapid access storage device.

FIG. 7 is perspective view of another embodiment of a rapid access and storage device 700, which can comprise the same components as device 600. Device 700 comprises a housing 710, including a set of fastener components 710, which can comprise any suitable fastener components, such as snaps, hook or loop fasteners, MOLLE fasteners, or a combination thereof. Housing 710 includes a set of fastener receivers 750, and shields 740*a*, 740*b* that provide smooth surfaces for cords 730*a*, 730*b* to slide along. Shields 740*a*, 740*b* can comprise any suitable material and may optionally clip on to an end portion of housing 710.

The view shown in FIG. 7 depicts an interior space or cavity 745 that can receive a carriage of the inventive matter. The user can pull a handle coupled to the carriage and pull the carriage out of the cavity 745 and against the retraction assembly(ies). The cords 730*a*, 730*b* can be coupled to the carriage via a coupling assembly that includes connectors 725*a*, 725*b* and complementary connectors coupled to the carriage. When the user pulls the handle, the user is able to pull the carriage and cords in Directions G and H (or any desired direction) to access any gear stowed within the carriage.

In some embodiments, the exterior of the housing 710 can have a first portion of the hook or the pile from hook-and-loop fasteners 715 attached, for carriage of additional gear. The first portion of the hook or the pile from hook-and-loop fasteners 715 can be positioned on a side opposite fastener components 720, which are used to attach device 700 to a wearable device or other object.

Figure 8:
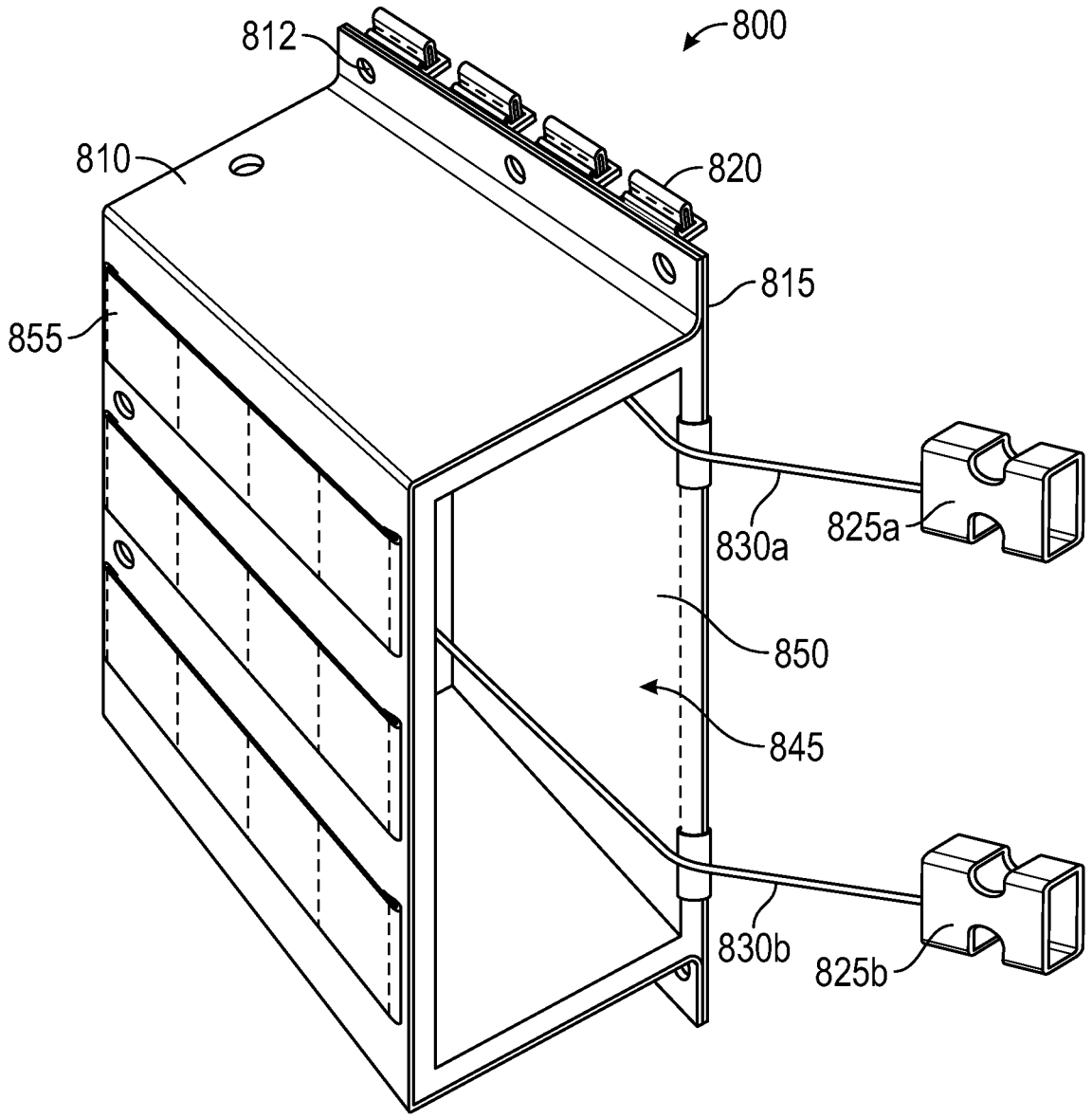
FIG. 8 illustrates another housing of a rapid access storage device.

FIG. 8 is a perspective view of another embodiment a device having a housing similar to the housing of FIG. 5. Rapid access and storage device 800 comprises a housing including a platform 815 coupled to bent portion 810 via rivets 812 or other fasteners. Platform 815 comprises a set of fasteners 820, which can comprise any suitable fastener for removably coupling device 800 to a wearable device or other object. Bent portion 810 comprises loops 855 affixed to it, which can receive complementary fasteners, such as MOLLE fasteners of another device or object. The inner surface of the housing can be lined with a fabric, ABS honeycomb or other material 850 affixed thereto. Cords 830*a* and 830*b* of retraction assemblies (not shown) may be pulled out of the housing through an end of the housing opposite the retraction assemblies via connectors 825*a*, 825*b*, which can be coupled to complementary connectors of a carriage being pulled out by the user (e.g., by pulling a handle of the carriage). Connector 825*a* and a complementary connector of the carriage form a coupling assembly. Connector 825*b* and complementary connector of the carriage can form another coupling assembly. Contemplated coupling assemblies include quick release connectors, a buckle and clasp, a carabiner and carabiner receiver (e.g., a loop or metal ring), or any other suitable coupling assemblies or even an adhesive that can permanently or removably couple a cord of a retraction assembly to the carriage.

Figure 9:
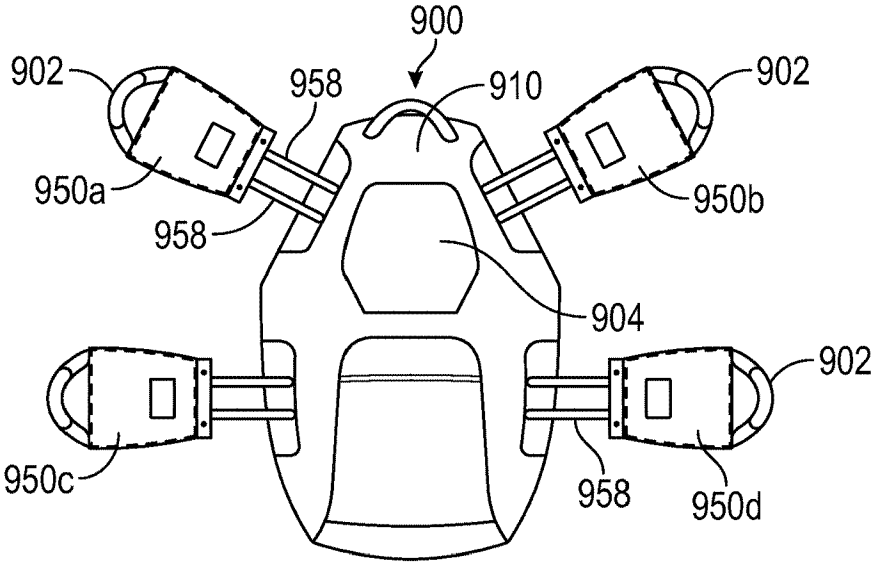
FIG. 9 illustrates another embodiment of a rapid access storage system.

FIG. 9 illustrates another embodiment of a rapid access storage system. System 900 comprises a wearable device 910 having a set of rapid access and storage devices. The wearable device 910 can resemble a turtle shell that can have a variety of rapid access and storage devices. In some examples, the wearable device 910 can be a bag or other object that can be worn by a user or attached to a vehicle, a wheel chair, or chest plate, for example, via one or more straps. The wearable device 910 can comprise a rigid, semi-rigid or flexible outer shell that comprises the outer most portion of the device 910. The wearable device 910 can have one or more carriages 950*a*, 950*b*, 950*c*, 950*d* that are contained within pockets, openings or sleeves of wearable device 910. In the embodiment illustrated, the wearable device 910 comprises or is the housing for the one or more carriages 950*a*, 950*b*, 950*c*, and 950*d*. Four carriages are shown in FIG. 9, but a system of the inventive subject matter can comprise any suitable number of carriages (e.g., 1, 2, 3, 4, 5, 6, 7, between 1-5, between 1-3, at least 2, at least 3, at least 4, at least 5 carriages). For example, the carriages 950*a*, 950*b* can be integrated into the wearable device 910 at the shoulder level, and the carriages 950*c*, 950*d* can be integrated into the wearable device 910 at the waist or torso level.

Each of the carriages 950*a-d* can have a handle 902. The handles 902 can be affixed or otherwise coupled to the carriages. A user can grasp the handles 902 and extend the carriage(s) 950*a-d* away from the wearable device 910, for example, as shown in FIG. 1. Each of the carriages 950*a-d* is coupled to a retraction assembly, contained within the wearable device 910, via one or more cords 958. The retraction assembly can be similar to those disclosed herein or in U.S. Provisional Application 62/888,293. The retraction assembly can be a reeling assembly having a retractable length of cord that reels the carriage it is coupled to back into the wearable device 910. In some embodiments, the retraction assembly can be formed from at least on elastic member (e.g., bands or bungee) that acts as a tensioner to retract the carriage into the housing or wearable device 910.

In some embodiments, the wearable device 910 can have a fastener component 904 (e.g., a hook or loop panel, sleeves/grids for receiving MOLLE™ fasteners) coupled to the outer surface, which a rapid access and storage device of other object having a complementary fastener component could couple to.

Figure 10:
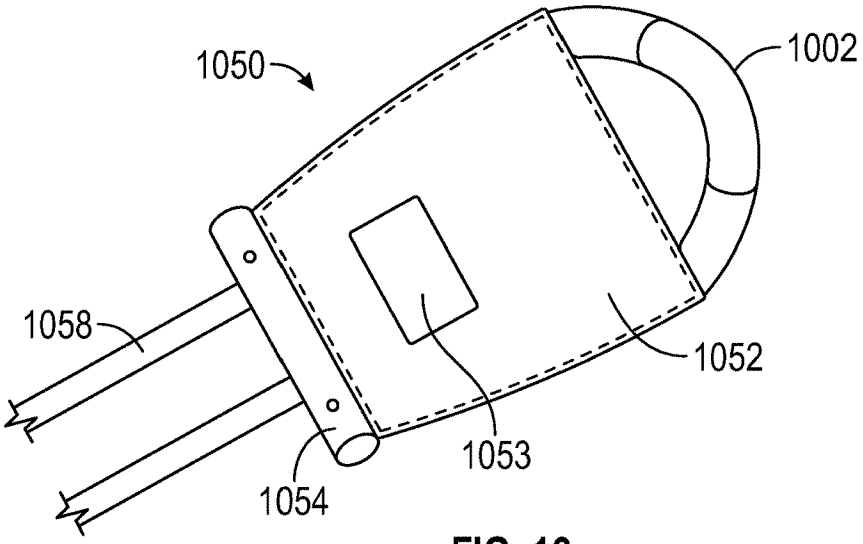
FIG. 10 illustrates a carriage of the rapid access storage system of FIG. 9.

FIG. 10 is a close up view of an embodiment of the carriage, which is identical to the carriage shown in FIG. 9. The carriage 1050 can have a panel portion 1052. The panel portion 1052 can be a thin sheet-like component having a flexible, semi-rigid, or rigid construction. The panel portion 1052 can include a fastener component such as a hook or loop fastener component (e.g., of Velcro), snaps, rings for receiving clips, a MOLLE grid, etc. on at least one side. In some examples, the panel portion 1052 can be entirely covered or substantially covered in such hook or loop fastener component(s) as shown with a dotted line border to allow storage of items including a complementary fastener component on one or both sides of the panel portion 1052 at various locations. The panel portion 1052 can further have one or more pockets 1053 or compartments for storing items. In some embodiments, the carriage can have a handle 1002 and a carriage support member 1054. The carriage support member 1054 can provide rigidity to the panel portion 1052 and be permanently or removably attached to cords 1058.

Figure 11:
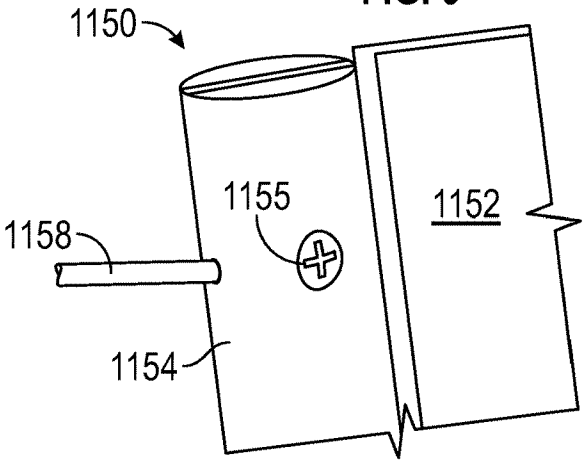
FIG. 11 illustrates a carriage support member of the carriage of FIG. 10.

FIG. 11 is a close up view of an embodiment of the carriage support member 1150, which is identical to carriage support member 1054 of FIG. 10. The carriage support member 1150 can provide a connection point between the panel portion 1152 and the one or more cords 1058. In some implementations, the carriage support member 1150 can be formed of two halves of a cylinder 1154 coupled together by at least one fastener 1155. The fastener(s) 1055 can couple the two halves of the carriage support member together, capturing the panel portion 1152 between them and securing it with an interference fit or clamping action between the two halves of the carriage support member 1150. The cords 1158 can further be coupled to the fastener(s) 1155 or the carriage support member, or other component of the carriage support member (e.g., inserted into an opening of cylinder 1154 and kept in place via a block of the cord that is larger than a diameter of the opening).

In another embodiment, the carriage support member 1150 can be a unitary piece formed to receive the panel portion 1152. The fasteners 1155 can then capture and secure the panel portion 152 in place.

Figure 12:
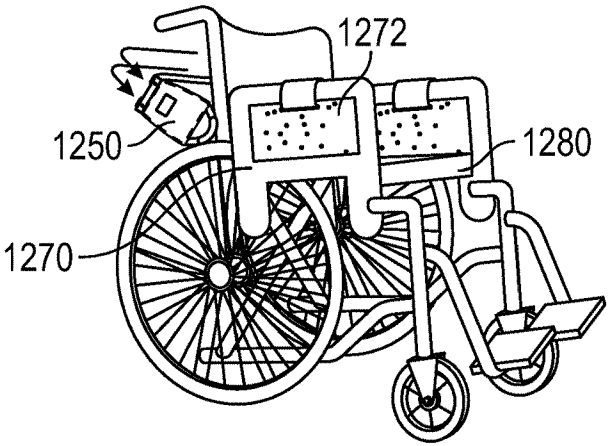
FIG. 12 illustrates a rapid access storage device on a wheelchair.

FIG. 12 illustrates a rapid access storage system on a wheelchair 1270. A system (e.g., System 900 of FIG. 9) may be hanging or otherwise positioned behind a seat back of wheelchair 1270 straps (e.g., a hooked hanger that hangs on a handle for pushing the wheelchair; straps that wrap around the seat back). The side arms or panels can comprise fastener components 1272 such as a hook or loop panel. Carriage 1250 can comprise a complementary fastener component. When a user pulls carriage 1250 out and away from the system or housing, the user could conveniently fasten the carriage 1250 to fastener component 1272 of the side arm or panel and access items stored thereon or therein. The user can then release the carriage 1250 and cause it to retract back into the system or housing. Additionally or alternatively one or more rapid access storage devices can be coupled to the side arm or panel (e.g., the housing of a rapid access storage device can be removably coupled to the side arm or panel).

Figure 13:
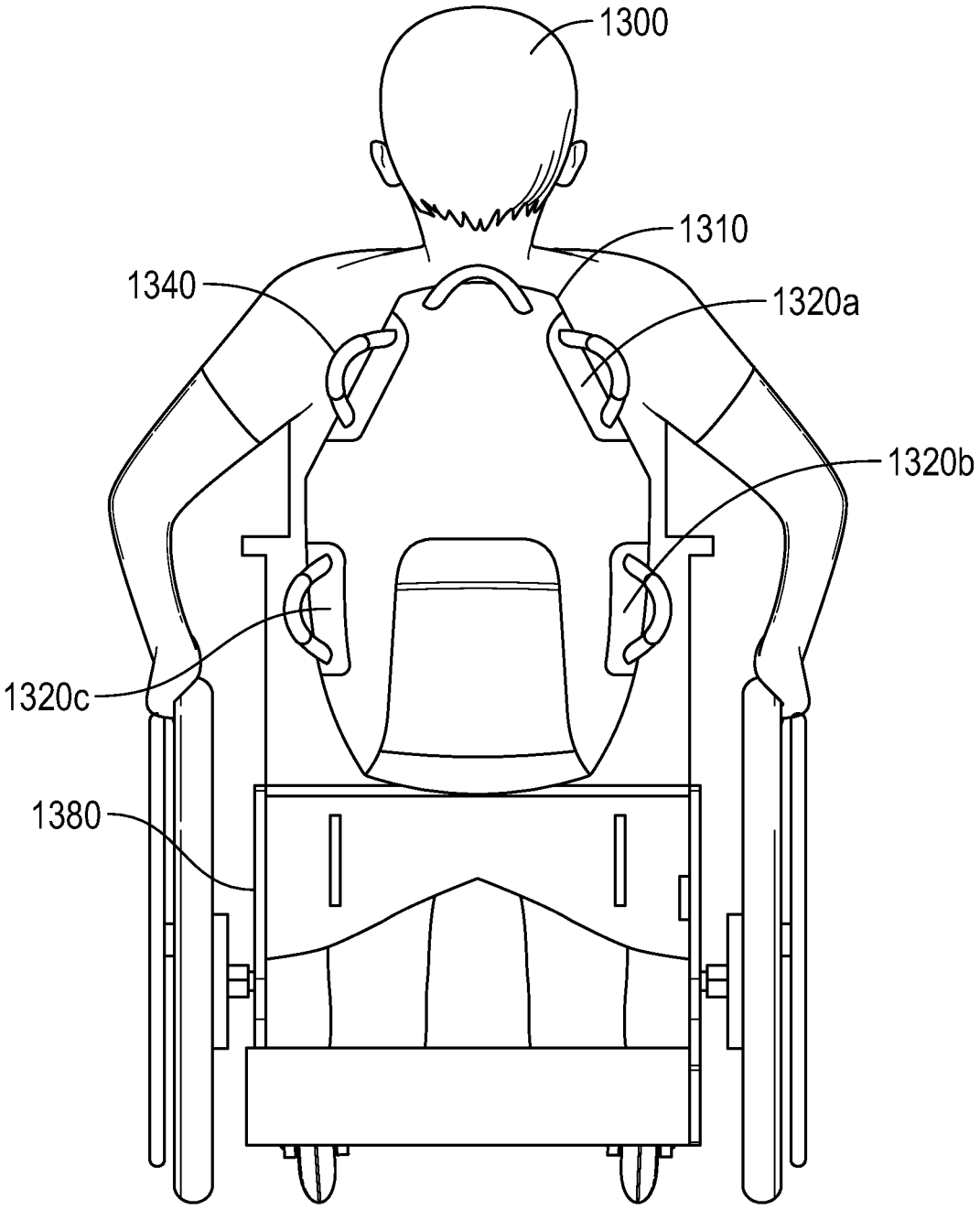
FIG. 13 illustrates a rapid access storage system on a wheelchair.

FIG. 13 illustrates a rapid access storage system on a wheelchair. The wheelchair 1380 is mounted with or otherwise coupled to an embodiment of the system 1310, which is very similar to the system of FIG. 9 and comprises four rapid access and storage devices (e.g., 1320*a*, 1320*b*, 1320*c*) having handles (e.g., 1340). In some implementations, the system 1310 can be adapted for use with a wheelchair 1380. In some examples, the system 1310 can be coupled to or form a part of a seat back of the wheelchair 1380. In some implementations, the system 1310 can be formed as a backpack and can hang from the back of the wheelchair 1380 by backpack straps or other fasteners. The system 1380 can be coupled to the back of the wheelchair as a permanent or semi-permanent attachment used for storage, or be formed as a unitary component with the seat back of the wheelchair 1380.

In some implementations, a fastener panel can be affixed to the wheelchair 1380. The fastener panel can have a hook or loop fastener surface. The system can comprise a complementary fastener panel, which can be used to removably fasten system 1310 to the wheelchair 1380. In some implementations, the user 1300 can pull the carriage (e.g., carriage 950*a-d* of FIG. 9) from the housing, which can be contained within a pocket of, or removably fastened to, the backpack. This can allow the user 1300 to stow or retrieve items stored in or on the carriages of the devices by pulling on the handles (e.g., 1340), which can be reached without a need to remove the backpack from the seat back of the wheelchair 1380. When complete, the user 1300 can release the handle and allow the retraction assembly to retract the carriage to a position within the housing.

The wheelchair 1380 is shown as an example. However, other configurations are also possible. For example, the system 1310 can be coupled or otherwise used within a seat back within a vehicle, allowing access by the operator to items stored therein.

Figure 14B:
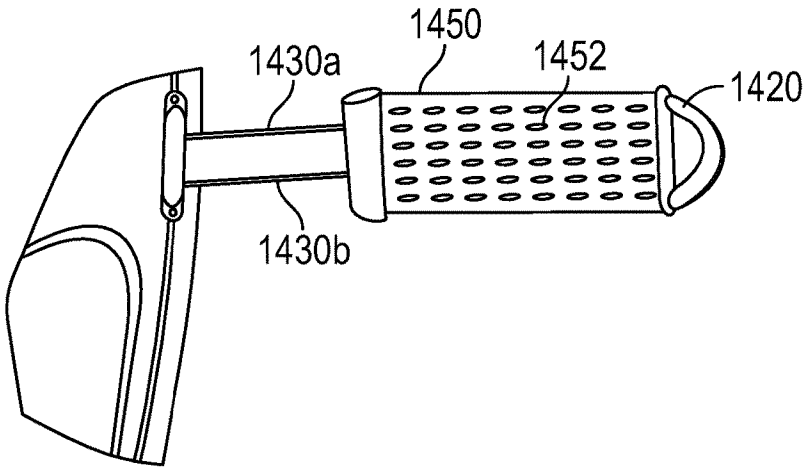
Figure 14D:
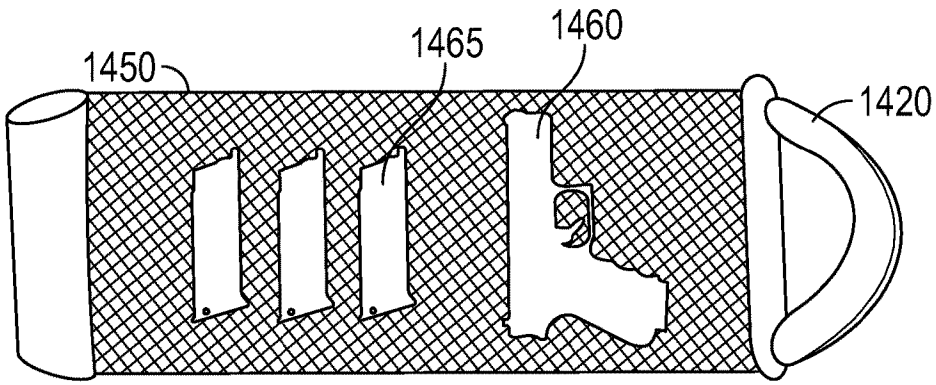
Figure 14A:
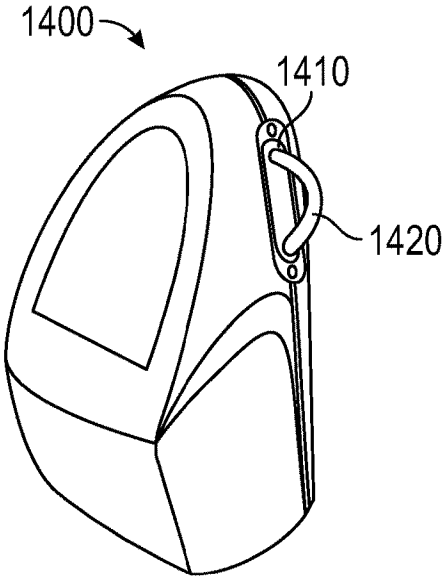
Figure 14C:
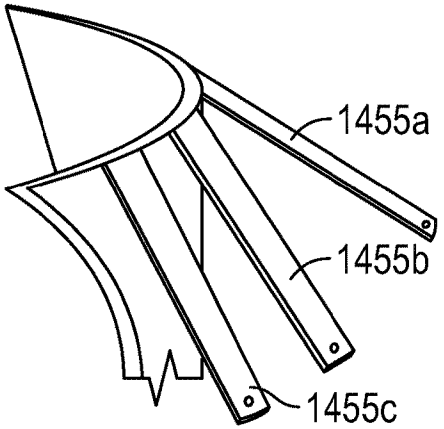

FIGS. 14A-D illustrate another embodiment of a rapid access storage system 1400. System 1400 comprises a wearable device that includes one or more rapid access storage devices 1410 housed within one or more pockets or recesses of the wearable device, and including one or more handles 1420, which can be pulled by a user to access stored items in or on a carriage 1450. The carriage 1450 can be similar to any of the carriages described herein, and have a retractable construction. The carriage 1450 can be pulled out from, and retracted within a housing, pocket or recess of wearable device 1400 by one or more retractable cords (1430*a*, 1430*b*) of one or more retraction assemblies. In FIG. 14B, carriage 1450 is extended from wearable device 1400. Carriage 1450 includes a panel portion including one or more fastener components 1452. For example, fastener components 1452 can comprise a series of perforations or sleeves for MOLLE-style stick connectors. As another example, fastener components 1452 can comprise a series of hook or loop fastener components, snap components, or a combination of perforations, sleeves, hook fasteners, loop fasteners, and snap components. As shown in FIG. 14D, items such as weapons 1460 and ammunition 1465 can be stored on or in carriage 1450. Here, the fastener components are shown as hook or loop fasteners, while FIG. 14B illustrates a set of perforations for receiving MOLLE-style connectors. It is contemplated that one side of a panel portion can comprise perforations while another side comprises hook or loop fastener components. FIG. 14C illustrates connects 1455*a*, 1455*b*, and 1455*c* for use with panel portion. The carriage 1450 and the panel portion can receive various pouches or other containers via a plurality connectors 1455*a-c*. The connectors 1455*a-c* can be similar to Slickstick or MOLLE-style connectors that interweave with the perforations (fastener components) 1452. Such a coupling can secure a pouch or other container to the panel portion or other portion of carriage 1450. The contents of the pouch or other container can then be pulled out from and retracted within the system 1400.

FIGS. 15A-B illustrate a rapid access storage system worn and used by a wearer 1500. The wearable device of the system can include straps 1520*a* and 1520*b* that allow user 1500 to wear the wearable device like a backpack or a sling. The straps 1520*a* and 1520*b* can be fitted with connectors (e.g., hook or loop, snaps) in various locations. Four patches of the connectors 1530*a*, 1530*b*, 1540*a*, 1540*b* are shown but it is contemplated any suitable number of connectors (e.g., at least 2, at least 4, at least 6, at least 8) can be provided on straps 1520*a*, 1520*b* or any other portion of the wearable device.

When deployed, the user 1500 can grasp the handle of the rapid access and storage device, which is coupled to carriage 1550, and pull the carriage out from the housing on a surface of the wearable device or within a pocket or recess of the wearable device. In some embodiments, the pocket or recess can comprise the housing of the rapid access and storage device. The carriage 1550 can be pulled around and over the shoulder in a direction with cords 1555*a*, 1555*b* keeping carriage coupled to the wearable device. The carriage 1550 can then be secured in place on the connectors (e.g., 1530*a*, 1540*b*) via fastener components (e.g., hook or loop, snaps) on a surface of the panel portion of carriage 1550, allowing the user to manipulate any items or gear stowed on the panel portion. For example, it is contemplated the carriage can be pulled upward diagonally from a rear of the wearer and over a shoulder, and then pulled downward diagonally from the shoulder to the front of the wearer. The connectors can couple with the panel portion against tension applied by the retraction assembly on the cords 1555*a*, 1555*b*.

In other examples, the carriage or a carriage of another rapid access and storage device on or in the wearable device can be pulled around the waist and fastened on couplers 1540*a*, 1540*b*.

FIG. 16 illustrates rapid access storage devices on a tactical vest. In the embodiment shown, a first, a second, a third and a fourth rapid access and storage device are affixed to (permanently or removably) to vest 1610 worn by a user 1600. Handles of the rapid access storage devices are oriented such that carriages within the two upper rapid access and storage devices can be pulled over the shoulders of the wearer, for example, in Direction I. Carriages within the two lower rapid access and storage devices can be pulled around the waist of the wearer, for example, in Direction J. Viewed from another perspective, the handles of the upper devices are positioned on the top of the devices, while the handles of the lower devices are positioned on the sides of the devices.

It should be appreciated that the rapid access and storage devices can be coupled to the wearable devices or other devices (e.g., wheelchairs) in any suitable orientation to allow a user to conveniently access the handles and stored items.

FIG. 17 illustrates a rapid access storage device on a front portion of a tactical vest, which can be the same vest/system shown in FIG. 16. The view shown in FIG. 16 can comprise the back of a tactical vest shown in FIG. 17. The devices, including device can be coupled to the vest 1610 or 1720 via various styles of connectors such as MOLLE or Slickstick strap-and-loop style connectors with vest 1610 or 1720 comprising a set of sleeves for the connectors to be contained within. Additionally or alternatively, the devices can comprise a hook or loop fastener(s) with the vest 1610 or 1720 having complementary hook or loop fastener(s). The same or other fastening assemblies can be used with other wearable items such as backpacks, ruck sacks, hanging compartments, and so forth. As illustrated in FIG. 17, a carriage 1750 can be pulled out from a device positioned on the back of the wearer/vest 1720, pulled around the waist of the wearer via a handle, and secured to a hook or loop fastener component 1760 on the front of the vest 1720. Carriage 1750 can comprise a complementary hook or loop fastener for temporarily securing carriage 1750 to the front of vest 1720 while the user manipulates any items stored in or on the carriage 1750. The hook-and-loop fasteners of the vest 1720 and carriage 1750 can secure the carriage 1750 to the tactical vest 1720 against the tension of the cords and the retraction assembly of the devices (e.g., the cords and retraction assembly of any of the embodiments described herein).

FIG. 18 illustrates a rapid access storage device 1800, which can be used as each of the four devices shown in FIG. 16. The device 1800 can be similar to any of the devices described herein. As illustrated, device 1800 comprises a housing 1810, which houses a carriage coupled to handle 1840. A front surface 1830 of device 1800 comprises a hook or loop fastener panel 1820 (or other fastener component) for coupling to one or more other devices or objects. The device 1800 can be a part of a modular storage system in which multiple devices 1800 can be mounted to a wearable device in any suitable orientation and position.

FIG. 19 illustrates a rapid access storage device with a carriage pulled away from housing. The device comprises a housing similar to housing 1810, which has an internal cavity for retractably receiving all or substantially all of a carriage 1960. Carriage 1960 is configured to hold items 1950 via compartments, fastener assemblies or a combination thereof. Carriage 1960 is coupled to the housing via a retraction assembly including one or more cords 1970. Carriage can be pulled away from the housing in Direction K (or any direction) by a user via handle 194, In some implementations, the cords 1970 can also be elastic similar to bungee or other retracting materials that can pull the carriage 1960 back into the housing.

FIGS. 20A-D illustrate rapid access storage devices on tactical vests. FIGS. 20A-D illustrate a few options for mounting the devices described herein (e.g., device 200, 600, 1800, a combination thereof) onto a wearable device. As shown, four devices labeled 2000*a*, 2000*b*, 2000*c*, 2000*d* are shown in various configurations. 1, 2, 3, 4, or any suitable number of devices can be removably coupled to the wearable device via any suitable fastener assembly (e.g., sleeves on the wearable device and MOLLE-style fastener components on the rapid access and storage devices; hook or loop fasteners on the wearable device and complementary hook or loop fasteners on the rapid access and storage devices). Each of the rapid access and storage devices can be positioned and oriented relative to the wearable device or user such that the carriages can be pulled by the user in any suitable direction (e.g., direction L, M, N or O) for rapid retrieval of items.

FIG. 21 illustrates a rapid access storage device with a single retraction assembly. FIG. 21 illustrates an exploded view of a housing of a rapid access storage device (which can be a rapid access storage device shown in FIG. 1, among other Figures and embodiments described herein). The rapid access storage device 2100 comprises a housing that includes a main body portion 2110, a funnel component 2120, and a retraction assembly end portion 2130 that contains or otherwise incorporates one or more retraction assemblies of the inventive subject matter. The main body portion 2110 comprises two open ends that are sized and dimensioned to couple with funnel component 2120 and retraction assembly end portion 2130. The main body portion 2110 comprises a set of fastener components 2115 (e.g., MOLLE-style stick fasteners), and an attachment surface 2117 made of a hook or loop material or other fastener component (e.g., snaps), which can removably couple with fastener components of other objects (e.g., other rapid access and storage devices) such that the rapid access storage devices can be stacked. The main body portion 2110, the funnel component 2120 and the retraction assembly end portion 2130 can be generally rigid or semi-rigid structures. The retraction assembly end portion 2130 can contain one or more retraction assemblies, for example, the assemblies shown in FIG. 6, or the assembly shown in FIG. 23. The retraction assembly or assemblies can include cord(s) 2125*a*, 2125*b*, elastic strap(s) or other component that include a coupling component for removably coupling with one or more carriages (e.g., any of the carriages described herein), which can include or be coupled to complementary coupling components of the cords 2125*a*, 2125*b*. The retraction assembly or assemblies can allow a user to pull the carriage away from within the housing while staying connected to the housing to retrieve an item, and pull the carriage back into the housing when released by the user.

The funnel component 2120 (or funnel portion of housing) can have a mouth wider than the opening provided in the main body portion 2110. The mouth can also be wider and taller than a side of the carriage that first enters the housing when released by a user. In some implementations the funnel component 2120 can serve as a feed funnel, providing about a 0.1-2 inch, about 0.1-1 inch, about 0.25-0.75 inch of an outer perimeter lip or outer edge of which the opening will have an outward slant. The outward slant could be angled relative to a second portion of component or housing main body portion 2110 surfaces at between 20-80 degrees, between 30-70 degrees, between 35-65 degrees, between 35-45 degrees, or any other suitable angle. This can provide for a wider opening to allow the smaller carriage (e.g., carriage 230 of FIG. 2) to be retracted and received into the housing with ease. The carriage is sized and dimensioned to be held entirely or partially within main body portion 2110. This can prevent the carriage from snagging or bumping into a portion of the housing or otherwise being obstructed when released by the user and retracted by the reeling assembly.

The funnel component 2120 and retraction assembly end portion 2130 can be coupled to main body portion 2110 in any suitable matter. For example, a second portion of funnel component 2120 could be sized and dimensioned to snugly fit within opening of main body 2110 at a first end, and a portion of retraction assembly end portion 2130 could be sized and dimensioned to snugly fit within the opening of main body 2110 at a second end opposite the first end. A glue or other adhesive could optionally be used to attach the second portion of funnel component 2120 and the portion of the retraction assembly end portion 2130 to an inner surface of main body portion 2110. It is also contemplated that the second portion of funnel component 2120 and the portion of the retraction assembly end portion 2130 could be sized and dimensioned to snugly fit around an outer surface of main body portion 2110, and the glue or other adhesive could optionally be used to attach the second portion of funnel component 2120 and the portion of the retraction assembly end portion 2130 to an outer surface of the main body portion 2110.

FIG. 22 illustrates another rapid access storage device with a single retraction assembly. FIG. 22 provides a perspective view of a rapid access and storage device. One or more carriages are positioned within the housing 2210 and not shown. The housing 2210 includes a retraction assembly end portion (illustrated as part of or attached to the main body of housing 2210), which can receive one or more retraction assemblies 2220 (e.g., the retraction assemblies of FIG. 6, the retraction assembly of FIG. 23). Each retraction assembly 2220 can contain a length of cord (e.g., cord ends 2225*a*, 2225*b*) or an elastic band (e.g., band 1058 of FIG. 10). Each retraction assembly can be, for example, similar to a high force key retractor having a high retraction force. Where the retraction assembly comprises a cord, the cord can be a lightweight rope with a high break strength such as Vectran, Dyneema, Kevlar, or other similar cordage. For example, the retraction assembly can comprise a 12 oz retraction force with a 80 pound break strength. The cord(s) can comprise any suitable length, including for example, at least 12 inches, at least 18 inches, at least 24 inches, at least 36 inches, or at least 42 inches. The retraction assemblies can further have a connector coupled to the cord for connecting and disconnecting the retraction assembly to the carriage, which can comprise complementary connectors (e.g., a clip to clip to loop of cord ends 2225*a*, 2225*b*).

Retraction assembly end portion comprises a set of openings 2217*a*, 2217*b*, which the cord ends 2225*a*, 2225*b* and connectors can extend through to couple with carriage positioned within a cavity of housing the housing 2210.

A user can pull a handle of a carriage, and exert a force sufficient to pull the carriage from the housing, and against the retraction assembly 2220 or assemblies. The user can retrieve or stow necessary items from/in the carriage. The user can then release the handle, and the retraction assemblies can retract the carriage back into the housing 2210.

In some examples, the retraction assemblies can also have a pull-to-retract arrangement, in which the user pulls the handle to retrieve the carriage; the cords remain extended until the user again puts the cords under a slight amount of tension to then reactivate the retraction assemblies. The carriage is then retracted within the housing 2210. An outer cover can be provided around the housing, such as a fabric. The outer cover or the housing 2210 can comprise a fastener panel 2215 for removably coupling with a fastener component of another rapid access and storage device or other object.

FIG. 23 illustrates another rapid access storage device with a single retraction assembly. The housing comprises a main body portion 2310 including a platform and bent portion coupled to one another via fasteners 2325, a retraction assembly end portion having openings 2335*a*, 2335*b*, and a set of fastener components 2330, which can comprise MOLLE style fastener components, straps, hook or loop fasteners, snaps, or any other suitable fastener components). A surface of the main body portion 2310 can comprise a set of sleeves 2315, which can be sized and dimensioned for coupling with MOLLE style fasteners of another rapid access and storage device or other items.

Each retraction assembly 2340 can contain a length of cord having cord ends 2345*a*, 2345*b*) or an elastic band (e.g., band 1058 of FIG. 10). The retraction assemblies can further have a connector coupled to the cord, band or other retraction element for connecting and disconnecting the retraction assembly to the carriage, which can comprise complementary connectors (e.g., a clip to clip to loop of cord ends 2345*a*, 2345*b*).

A user can pull a handle of a carriage, and exert a force sufficient to pull the carriage from the housing, and against the retraction assembly 2340 or assemblies. The user can retrieve or stow necessary items from/in the carriage. The user can then release the handle, and the retraction assemblies can retract the carriage back into the housing 2310.

FIG. 24 illustrates an embodiment of a retraction assembly (cords not shown). The retraction assembly 2400 comprises a housing 2410, guide rod tensioners 2430*a*, 2430*b*, a guide rod 2420, and attachment points 2435, 2445 for coupling to one or more cords (e.g., a 0.5-1.5 inch nylon strap). For example, cords having cord ends 2345*a*, 2345*b* of FIG. 23 can be fastened or affixed to attachment points 2435, 2445. The embodiment illustrated may be used, for example, for large carriages where a single retraction assembly is used. In some other embodiments, one or more retraction assemblies used to retract a carriage can comprise a single flat coil or other tensioner coupled to a cord. When a user pulls a handle coupled to a carriage that is coupled to the cord, the user can cause the spring inside the retraction assembly housing to extend. When the user releases the handle, the cord or other element retracts and the spring returns to its original wound up configuration pulling in the carriage into the housing. Each carriage can be coupled to one, two, three, or any suitable number of retraction assemblies.

Thus, various embodiments of rapid access storage devices and systems of the inventive subject matter have been disclosed herein. Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes, relative positions, and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

As used herein, and unless the context dictates otherwise, the term "coupled to" is intended to include both direct coupling (in which two elements that are coupled to each other contact each other) and indirect coupling (in which at least one additional element is located between the two elements).

The recitation of ranges of values herein is merely intended to serve as a shorthand method of referring individually to each separate value falling within the range, and including the endpoints. Unless otherwise indicated herein, each individual value is incorporated into the specification as if it were individually recited herein.

The term "substantially" as used herein means within 10%. For example, where substantially all of a carriage is housed within a housing, at least 90% of the carriage can be positioned within the housing.

Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "assembly," "mechanism," "element," "device," and the like may not be a substitute for the word "means." As such, no claim element is to be construed as a means plus function unless the element is expressly recited using the phrase "means for."

Although the present disclosure provides certain example embodiments and applications, other embodiments that are apparent to those of ordinary skill in the art, including embodiments which do not provide all of the features and advantages set forth herein, are also within the scope of this disclosure. The accompanying claims and their equivalents are intended to cover such forms or modifications as would fall within the scope of the disclosure. The features and attributes of the specific example embodiments of the rapid access and storage devices disclosed above may be combined in different ways to form additional embodiments, all of which fall within the scope of the disclosure.

What is claimed is:

1. A rapid access storage device, comprising:

a rigid housing forming a cavity, the housing having a first side with an opening, a second side opposite the first side, and a funnel portion extending from the opening away from the second side, the funnel portion having a mouth that is wider than the opening;

a carriage comprising at least one rigid portion, the carriage having a resting position within the cavity between the opening and the second side;

at least one retraction assembly proximate the second side and coupled to the carriage via a quick release connector, the at least one retraction assembly comprising a tensioner and a cord with the tensioner biasing the carriage to be within the cavity of the housing.

2. The rapid access storage device of claim 1, wherein the tensioner and the cord are comprised of a single elastic cord.

3. The rapid access storage device of claim 1, wherein the tensioner comprises a spring.

4. The rapid access storage device of claim 1, wherein the second side has one or more second openings, and wherein the at least one retraction assembly comprises a body that is positioned on a side of the second side that is opposite the first side, with the cord extending from the body through one of the one or more second openings into the cavity to couple to the carriage via the quick-release connector.

5. The rapid access storage device of claim 1, wherein an outer surface of the housing comprises a fastener component for removably coupling the rapid access storage device to a wearable device.

6. The rapid access storage device of claim 5, wherein the fastener component comprises a Molle stick fastener.

7. The rapid access storage device of claim 5, wherein the fastener component comprises a hook or loop fastener.

8. The rapid access storage device of claim 5, wherein an outer surface of the housing further comprises a second fastener component for removably coupling to a fastener component of a second rapid access storage device, and wherein the first and second fastener components are positioned on opposite sides of the housing.

9. The rapid access storage device of claim 1, wherein the rigid portion comprises a panel and the carriage further comprises at least one compartment extending from the panel.

10. The rapid access storage device of claim 1, further comprising a second retraction assembly coupled to the carriage via a quick release connector.

11. The rapid access storage device of claim 1, wherein the retraction assembly comprises two cords and one or more tensioners.

12. The rapid access storage device of claim 1, wherein the cord comprises a strap.

13. The rapid access storage device of claim 1, wherein the carriage further comprises a fastener component for removing coupling a stored object to the carriage.

14. A rapid access and storage system, comprising:

a wearable device which can be worn by a user, the wearable device comprising a first rapid access storage device coupled to the wearable device;

wherein the first rapid access storage device, comprises:

a rigid housing forming a cavity, the housing having a first side with an opening, a second side opposite the first side, and a funnel portion extending from the opening away from the second side, the funnel portion having a mouth that is wider than the opening;

a retraction assembly proximate the second side and comprising a tensioner and a cord with the tensioner biasing the cord away from the opening toward the second side; and a carriage with a resting position within the cavity between the opening and the retraction assembly, the carriage having at least one rigid portion and coupled to the cord via a quick release connector.

15. The rapid access and storage system of claim 14, further comprising a second rapid access storage device coupled to the wearable device.

16. The rapid access and storage system of claim 14, wherein the wearable device is a backpack or a tactical vest.

17. A rapid access storage device, comprising:

a rigid housing forming a cavity, the housing having a first side with an opening, a second side opposite the first side, and a funnel portion extending from the opening away from the second side, the funnel portion having a mouth that is wider than the opening;

a retraction assembly proximate the second side and comprising a tensioner and a cord with the tensioner biasing the cord away from the opening toward the second side; and a carriage with a resting position within the cavity between the opening and the retraction assembly, the carriage coupled to the cord via a quick release connector.

18. The rapid access and storage system of claim 17, wherein the carriage comprises a panel and at least one compartment extending from the panel.

19. The rapid access storage system of claim 17, wherein the funnel portion comprises a funnel component and a second portion extending from the funnel component through the opening and the second portion fits within the opening.

20. The rapid access storage system of claim 17, wherein the tensioner comprises a spring.

* * * * *